US006811963B2

(12) United States Patent
Johnston et al.

(10) Patent No.: US 6,811,963 B2
(45) Date of Patent: Nov. 2, 2004

(54) COLOR PHOTOGRAPHIC MATERIAL WITH IMPROVED SENSITIVITY

(75) Inventors: Sharon G. Johnston, Rochester, NY (US); Stephen P. Singer, Spencerport, NY (US); Drake M. Michno, Webster, NY (US); James A. Friday, Rochester, NY (US); David R. Foster, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/346,582

(22) Filed: Jan. 17, 2003

(65) Prior Publication Data

US 2004/0146815 A1 Jul. 29, 2004

(51) Int. Cl.[7] ..... G03C 1/46

(52) U.S. Cl. ..... 430/506; 430/509; 430/600; 430/611; 430/613; 430/615; 430/505; 430/558; 430/570; 430/572; 430/574; 430/581

(58) Field of Search ..... 430/506, 505, 430/509, 600, 611, 613, 615, 558, 570, 572, 574, 581

(56) References Cited

U.S. PATENT DOCUMENTS

| | | | |
|---|---|---|---|
| 3,622,316 | A | 11/1971 | Bird et al. |
| 6,048,681 | A | 4/2000 | Suzumoto et al. |
| 6,117,629 | A | 9/2000 | Yamashita et al. |
| 6,143,486 | A | 11/2000 | Parton et al. |
| 6,165,703 | A | 12/2000 | Parton et al. |
| 6,312,883 | B1 | 11/2001 | Parton et al. |
| 6,319,660 | B1 | 11/2001 | Allway et al. |
| 6,329,133 | B1 | 12/2001 | Andrievsky et al. |
| 6,331,385 | B1 | 12/2001 | Deaton et al. |
| 6,361,932 | B1 | 3/2002 | Parton et al. |

FOREIGN PATENT DOCUMENTS

| | | |
|---|---|---|
| EP | 1 061 411 A1 | 12/2000 |
| EP | 1 199 600 A2 | 4/2002 |
| EP | 0 838 719 B1 | 2/2003 |
| JP | 10/171058 | 6/1998 |

OTHER PUBLICATIONS

Thomas L. Penner et al, *Photographic Science and Engineering*, "Spectral Shifts and Physical Layering of Sensitizing Dye Combinations in Silver Halide Emulsions", *vol. 20, 1976, pp. 97–106.*

Thomas L. Penner, *Photographic Science and Engineering*, "Electrophoresis of Spectral Sensitizing Dyes on Silver Halide: Evidence for Dye Layering", vol. 21, 1977, pp. 32–36.

IP.com publication 000006637D published Jan. 17, 2002, pp. 1–51.

U.S. application Ser. No. 10/346,273 files Jan. 17, 2003 "Color Photographic Material With Improved Sensitivity Comprising a Pyrazolotriazole Coupler" of Sharon G. Johnston et al.

U.S. application Ser. No. 10/346,745 filed Jul. 17, 2003 "A Method of Making a Silver Halide Photographic Material Having Enhanced Light Absorption and Low Fog" of David R. Foster et al.

U.S. application Ser. No. 10/347,014 file dJan. 17, 2003 "Silver Halide Material Comprising Low Stain Antenna Dyes" of Richard L. Parton et al.

*Primary Examiner*—Geraldine Letscher
(74) *Attorney, Agent, or Firm*—Sarah Meeks Roberts

(57) ABSTRACT

This invention relates to a silver halide photographic element comprising a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler, wherein at least one of the dye image forming units contains layers of differing sensitivities, and the layer of highest sensitivity contains a development promoting agent or a specific coupler as described herein, or a combination thereof, and a silver halide emulsion comprising tabular silver halide grains having associated therewith at least two dye layers comprising (a) an inner dye layer adjacent to the silver halide grain and comprising at least one dye, Dye 1, that is capable of spectrally sensitizing silver halide and (b) an outer dye layer adjacent to the inner dye layer and comprising at least one dye, Dye 2, wherein the dye layers are held together by more than one non-covalent force; the outer dye layer absorbs light at equal or higher energy than the inner dye layer; and the energy emission wavelength of the outer dye layer overlaps with the energy absorption wavelength of the inner dye layer.

26 Claims, No Drawings

COLOR PHOTOGRAPHIC MATERIAL WITH IMPROVED SENSITIVITY

FIELD OF THE INVENTION

This invention relates to a silver halide photographic material containing at least one silver halide emulsion that has enhanced light absorption. The invention is directed in particular to a color photographic material with high sensitivity, reduced granularity and radiation sensitivity.

BACKGROUND OF THE INVENTION

Increasing the sensitivity of silver halide based imaging composites to reflected scene information offers the potential for improved photographic performance. Examples of how increased response to light within the visible spectrum can provide system specific benefits include: (i) shorter exposure times which in turn enables "stop-action" image capture; (ii) increased depth of field enabled by the use of a smaller effective aperture; (iii) or improved penetration of artificial illuminants (so-called "flash distance").

However, as executed to date, examples of silver halide based image capture media which display increased sensitivity have suffered from at least two major problems. The first relates to increased noise (or 'graininess') associated with the conventional tactic of increasing detector (emulsion crystal) size to elevate sensitivity. The second area of dissatisfaction related to existing highly light sensitive photographic materials is the rapid and significant reduction in signal-to-noise {S/N} response as these composites are exposed to normal background radiation outside the visible spectrum. The combination of these two facets of existing high speed emulsions can yield inferior results under normal usage conditions, severely compromising the utility described above.

In general, useful photographic sensitivity is correlated with the size of the most light sensitive silver halide detector (emulsion) employed. For tabular emulsions, the operative size variable is surface area per crystal, which in turn is a direct function of the equivalent circular diameter (ECD). Unfortunately, noise, as measured by micro-scale density variation or granularity, is also directly correlated with ECD. Equally distressing is the observation that sensitivity to radiation (outside the visible spectrum) is also a direct function of ECD, with larger ECD having greater sensitivity to and increased damage from radiation. Typical damage imparted from radiation exposure includes: (i) reduced discrimination due to increased minimum density (D-min); (ii) reduction in intended sensitivity to visible light and (iii) increased granularity.

Conceptually, one potential solution which simultaneously addresses both concerns associated with high speed photography would be to provide equivalent sensitivity (or speed) with silver halide crystals of smaller ECD. Central to this goal involves enhancing the amount of spectrally specific light absorbed by the crystal.

J-aggregating cyanine dyes are used in many photographic systems. It is believed that these dyes adsorb to a silver halide emulsion and pack together on their "edge" which allows the maximum number of dye molecules to be placed on the surface. However, a monolayer of dye, even one with as high an extinction coefficient as a J-aggregated cyanine dye, absorbs only a small fraction of the light impinging on it per unit area. The advent of tabular emulsions allowed more dye to be put on the grains due to the increased surface area per mole of silver. However, in most photographic systems, it is still the case that not all of the available light is being collected.

The need is especially great in the blue spectral region where a combination of low source intensity and relatively low dye extinction results in a deficient photo response. The need for increased light absorption is also great in the green sensitization of the magenta record of multilayer color film photographic elements. The eye is most sensitive to the magenta image dye and this layer has the largest impact on color reproduction. Higher speed in this layer can be used to obtain improved color and image quality characteristics. The cyan layer could also benefit from increased red-light absorption that could allow the use of smaller emulsions with less radiation sensitivity and improved color and image quality characteristics. For certain applications, it may be useful to enhance infrared light absorption in infrared sensitized photographic elements to achieve greater sensitivity and image quality characteristics.

One way to achieve greater light absorption is to increase the amount of spectral sensitizing dye associated with the individual grains beyond monolayer coverage of dye (some proposed approaches are described in the literature, G. R. Bird, *Photogr. Sci. Eng.*, 18, 562 (1974)). One method is to synthesize molecules in which two dye chromophores are covalently connected by a linking group (see U.S. Pat. No. 2,518,731, U.S. Pat. No. 3,976,493, U.S. Pat. No. 3,976,640, U.S. Pat. No. 3,622,316, Kokai Sho 64(1989)91134, and EP 565,074). This approach suffers from the fact that when the two dyes are connected they can interfere with each other's performance, e.g., not aggregating on or adsorbing to the silver halide grain properly.

In a similar approach, several dye polymers were synthesized in which cyanine dyes were tethered to poly-L-lysine (U.S. Pat. No. 4,950,587). These polymers could be combined with a silver halide emulsion, however, they tended to sensitize poorly and dye stain (an unwanted increase in D-min due to retained sensitizing dye after processing) was severe in this system and unacceptable.

A different strategy involves the use of two dyes that are not covalently linked to one another. In this approach the dyes can be added sequentially and are less likely to interfere with each other. Miyasaka et al. in EP 270 079 and EP 270 082 describe silver halide photographic material having an emulsion spectrally sensitized with an adsorbable sensitizing dye used in combination with a non-adsorbable luminescent dye that is located in the gelatin phase of the element. Steiger et al. in U.S. Pat. No. 4,040,825 and U.S. Pat. No. 4,138,551 describe a silver halide photographic material having an emulsion spectrally sensitized with an adsorbable sensitizing dye used in combination with a second dye that is bonded to gelatin. The problem with these approaches is that unless the dye that is not adsorbed to the grain is in close proximity to the dye adsorbed on the grain (less than 50 angstroms separation) efficient energy transfer will not occur (see T. Förster, *Disc. Faraday Soc.*, 27, 7 (1959)). Most dye off-the-grain in these systems will not be close enough to the silver halide grain for energy transfer, but will instead absorb light and act as a filter dye leading to a speed loss. A good analysis of the problem with this approach is given by Steiger et al. (*Photogr. Sci. Eng.*, 27, 59 (1983)).

A more useful method is to have two or more dyes form layers on the silver halide grain. Penner and Gilman described the occurrence of greater than monolayer levels of cyanine dye on emulsion grains, *Photogr. Sci. Eng.*, 20, 97 (1976); see also Penner, *Photogr. Sci. Eng.*, 21, 32 (1977). In these cases, the outer dye layer absorbed light at a longer wavelength than the inner dye layer (the layer adsorbed to the silver halide grain). Bird et al. in U.S. Pat. No. 3,622,316 describe a similar system. A requirement was that the outer dye layer absorb light at a shorter wavelength than the inner layer. A problem with previous dye layering approaches was that the dye layers described produced a very broad sensitization envelope. This may be desirable for some black and white photographic applications, but in a multilayer color film element this would lead to poor color reproduction since, for example, the silver halide grains in the same color record would be sensitive to both green and red light.

Yamashita et al. (EP 838 719 A2, U.S. Pat. No. 6,117,629) describes the use of two or more cyanine dyes to form more than one dye layer on silver halide emulsions. The dyes are required to have at least one aromatic or heteroaromatic substituent attached to the chromophore via the nitrogen atoms of the dye. Yamashita et al. teaches that dye layering will not occur if this requirement is not met. This is undesirable because such substitutents can lead to large amounts of retained dye after processing (dye stain) that affords increased D-min. Similar results are described in U.S. Pat. No. 6,048,681 and EP 1,061,431A1. EP 1,061,411A1 describes forming dye layers by using dyes with additional polycyclic rings. The dyes have at least one heterocyclic ring that has two or more additional rings attached to it. This may promote dye-dye interactions by increasing van der Waals forces, however, adding hydrophobic, aromatic rings to the dye molecules is undesirable in that the dyes are more likely to be retained after processing and give higher dye stain.

Yamashita and Kobayashi (JP 10/171058) describe silver halide photographic emulsions that contain an anionic dye and a cationic dye, where the charge of either the anionic dye or the cationic dye is 2 or greater. Tadashi and Takashi describe (JP2001013614 A) combinations of cyanine dyes wherein the logP for the dye combination is in a certain preferred range.

Further improvements in dye layering have been described in U.S Pat. No. 6,143,486, U.S. Pat. No. 6,165,703, U.S. Pat. No. 6,329,133, U.S. Pat. No. 6,331,385, and U.S. Pat. No. 6,361,932. Useful antenna dyes (dyes in the the outer layer of the multilayer) for dye layering that have less dye stain after processing were described in U.S. Pat. No. 6,312,883.

Photographic origination materials for general use require sufficient latitude of exposure to record scenes of widely varying luminance; especially for use in simple cameras with fixed exposure used under a wide variety of lighting conditions. It is well known in the art to provide an element with two, three, four or more layers in each color record containing silver halide emulsions of successively different sensitivity in order to provide the desired exposure latitude. At the same time, the emulsion characteristics must be carefully chosen such that the overall characteristic curve relating density to exposure of the material, which is the combined response of the individual layers, is linear in order to reproduce the original scene faithfully.

At the same time high sensitivity and fine image structure are demanded in the marketplace. In addition, the fine image structure must be maintained during the life of the product prior to photographic processing despite the impact of high energy background radiation.

The emulsions sensitized by the dye-layering technique can be designed to provide higher sensitivity to the fastest layer or they may be used to obtain high speed with a decreased grain size and granularity improvement when employed in the most sensitive layer. However, the use of dye-layered emulsions in the most sensitive element can have significant, detrimental consequences. In particular, it is to be anticipated that enhanced absorption of light by the dye-layering technique relative to an emulsion of similar speed not featuring the dye-layering technique will optically retard participation of underlying layers of similar spectral sensitivity. None of the existing prior art provides insight as to how to compensate for this aspect of dye-layering emulsions.

It is well known to provide the fastest layer with less than a stoichiometric amount of coupler to reduce the unwanted, continued contribution of the largest grains to granularity in high exposures. This results, however, in a concomitant reduction of the latitude of the fastest layer. A choice of a larger grain size emulsion for the layer of second highest sensitivity would result in increased granularity.

Allway et al. U.S. Pat. No. 6,319,660 disclose a speed-enhancing compound (development promoting agent or DPA) with a minimum of three heteroatoms and a Clog P sufficient to increase the photographic speed of the photographic material compared to the same material without the compound. Unknown in the art, however, is how or if this technology has any beneficial utility in unison with dye-layered emulsions.

The problem remains to provide a silver halide photographic element having a combination of fastest and intermediate layers with a linear characteristic curve, high speed, and low granularity.

SUMMARY OF THE INVENTION

In one embodiment this invention provides a silver halide photographic element comprising a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler, wherein at least one of the dye image forming units contains layers of differing sensitivities, and the layer of highest sensitivity contains a development promoting agent and a silver halide emulsion comprising tabular silver halide grains having associated therewith at least two dye layers comprising (a) an inner dye layer adjacent to the silver halide grain and comprising at least one dye, Dye 1, that is capable of spectrally sensitizing silver halide and (b) an outer dye layer adjacent to the inner dye layer and comprising at least one dye, Dye 2, wherein the dye layers are held together by more than one non-covalent force; the outer dye layer absorbs light at equal or higher energy than the inner dye layer; and the energy emission wavelength of the outer dye layer overlaps with the energy absorption wavelength of the inner dye layer.

In another embodiment this invention provides a silver halide photographic element comprising a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler, wherein at least one of the dye image forming units contains layers of differing sensitivities, and the layer of highest sensitivity contains a coupler represented by Formula IIIa (Formula IIIa)

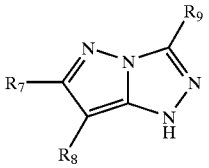

where $R_7$ is an alkyl, aryl, alkyloxy or aryloxy group, $R_8$ is a coupling group, and $R_9$ is an alkyl or aryl group containing at least 8 carbon atoms; and a silver halide emulsion comprising tabular silver halide grains having associated therewith at least two dye layers comprising (a) an inner dye layer adjacent to the silver halide grain and comprising at least one dye, Dye 1, that is capable of spectrally sensitizing silver halide and (b) an outer dye layer adjacent to the inner dye layer and comprising at least one dye, Dye 2, wherein the dye layers are held together by more than one non-covalent force; the outer dye layer absorbs light at equal or higher energy than the inner dye layer; and the energy emission wavelength of the outer dye layer overlaps with the energy absorption wavelength of the inner dye layer.

Surprisingly, it has been found that the elements of the invention have high sensitivity, a linear characteristic curve, and low granularity.

DETAILED DESCRIPTION OF THE INVENTION

The invention is generally as described above. Typically, the color silver halide photographic element useful in the present invention comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. It is preferred that the color silver halide elements are negative working silver halide elements. It is also preferred that the silver halide photographic elements are capture or origination elements such a color negative film or a motion picture origination film.

In the photographic elements of the invention at least one of the dye image forming units contains silver halide emulsion layers of differing sensitivities. The image dye forming unit may comprise two or more layers of differing sensitivities. It may comprise various combinations of layers having fast, intermediate or slow sensitivities. There may be more than one fast, slow or intermediate layer. Regardless of the make up of the dye image forming unit, the layer of highest sensitivity comprises either a development promoting agent or a specific class of pyrazolotriazole coupler. Particularly useful is a combination of the two. The layer of highest sensitivity also contains a silver halide emulsion comprising silver halide grains having associated therewith at least two dye layers. Other layers of the image dye forming unit may also contain dye layering. The dye layers comprise (a) an inner dye layer adjacent to the silver halide grain and comprising at least one dye, Dye 1, that is capable of spectrally sensitizing silver halide and (b) an outer dye layer adjacent to the inner dye layer and comprising at least one dye, Dye 2. The dye layers are held together by a non covalent attractive force such as electrostatic bonding, van der Waals interactions, hydrogen bonding, hydrophobic interactions, dipole-dipole interactions, dipole-induced dipole interactions, London dispersion forces, cation—π interactions, etc., or by in situ bond formation. The inner dye layer(s) is adsorbed to the silver halide grains and contains at least one spectral sensitizer. The outer dye layer(s) (also referred to as an antenna dye) absorbs light at an equal or higher energy (equal or shorter wavelength) than the adjacent inner dye layer(s). The light energy emission wavelength of the outer dye layer overlaps with the light energy absorption wavelength of the adjacent inner dye layer. Preferably the dye image forming unit containing the dye layered silver halide emulsion is the magenta dye image forming unit.

Dye 1 may be, for example, a cyanine dye, a merocyanine dye, arylidene dye, complex merocyanine dye, styryl dye, hemioxonol dye, oxonol dye, anthraquinone dye, triphenylmethane dye, azo dye type, azomethine dye, or a coumarin dye. More preferrably Dye 1 is a cyanine dye.

In one preferred embodiment Dye 1 comprises at least one anionic substiutent. Examples of anionic substituents are alkyl groups containing acid salts. Acid salt are salts of sulfonic acids, sulfato groups, salts of phosphonic acids, salts of carboxylic acids, and salts of nitrogen acids, such as imides, N-acylsulfonamides, and N-sulfonylsulfonamides. The preferred acid salt substituents are salts of sulfonic acids, carboxylic acids, and nitrogen acids. The alkyl groups bearing the acid salt substituent may be further substituted. Some specific examples of preferred alkyl groups with acid salt substituents include, but are not limited to: 2-sulfoethyl, 3-sulfopropyl, 3-sulfobutyl, 4-sulfobutyl, 3-sulfo-2-hydroxypropyl, sulfoethylcarbamoylmethyl, 2-carboxyethyl, 3-carboxypropyl, 2-sulfo-2-carboxyethyl, methanesulfonylcarbamoylmethyl, and the like.

Dye 2 may be, for example, a cyanine dye, a merocyanine dye, arylidene dye, complex merocyanine dye, styryl dye, hemioxonol dye, oxonol dye, anthraquinone dye, triphenylmethane dye, azo dye type, azomethine dye, or a coumarin dye. More preferrably Dye 2 is not a cyanine dye. Most preferably Dye 2 is a merocyanine dye. A merocyanine dye has one basic nucleus and one acidic nucleus separated by a conjugated chain having an even number of methine carbons (see *The Theory of the Photographic Process*, $4^{th}$ edition, T. H. James, editor, Macmillan Publishing Co., New York, 1977 for an explanation of basic and acidic nuclei).

Dye 2 preferably has at least one cationic substitutent. The term "cationic substituent" includes a substituent which can be protonated to become a cationic substituent. Examples of positively charged substituents are 3-(trimethylammonio) propyl), 3-(4-ammoniobutyl), 3-(4-guanidinobutyl) etc. Other examples are any substitutents that take on a positive charge in the silver halide emulsion melt, for example, by protonation such as aminoalkyl substitutents, e.g. 3-(3-aminopropyl), 3-(3-dimethylaminopropyl), 4-(4-methylaminopropyl), etc. In a preferred embodiment of the invention Dye 1 comprises at least one anionic substiutent, and Dye 2 comprises at least one cationic substitutent.

Specific spectral sensitizing dyes (Dye 1) and antenna dyes (Dye 2) useful in the invention and methods of dye layering are described in detail in Parton et al. European patent application publications EP 985,967, corresponding to U.S. Pat. No. 6,361,932, and EP 1,199,595, corresponding to U.S. application Ser. No. 09/690,068, filed Oct. 16, 2000, U.S. Pat. Nos. 6,143,486, 6,165,703, 6,312,883, Deaton et al. U.S. Pat. No. 6,331,385 and Andrievsky et al. U.S. Pat. No. 6,329,133, the entire contents of which are herein incorporated by reference. The dyes of the commonly-assigned and co-filed U.S. patent application of Parton, et al., SILVER HALIDE MATERIAL COMPRISING LOW STAIN ANTENNA DYES, is also incorporated herein by reference. Dye 1 and Dye 2 are also described in detail in "Technology Useful in Combination With Antenna Dyes" IP.com, Publication 000006637D, (IPCOM000006637D), published Jan. 17, 2002, pp. 1–51. Also discussed in the above references are methods to determine if dye layering has occurred, said discussion also incorporated by reference.

In one embodiment of the invention development promoting agents are added to the layer of highest sensitivity which also comprises a dye layered emulsion. The development promoting agent used in the invention can be any of those known in the art as, for example, in U.S. Pat. No. 6,455,242 and U.S. Pat. No. 6,319,660. These are generally compounds that have a minimum of three heteroatoms that do not react with oxidized developer and have a ClogP (a calculated measure of hydrophobicity as described in the references above) sufficient to increase the speed or light sensitivity of an imaging layer compared to the same layer without the compound. Among the classes of compounds that contain a minimum of three heteroatoms and can be included in the invention when appropriately substituted to increase hydrophobicity are: triazoles, oxadiazoles, thiadiazoles, oxathiazoles, thiatriazoles, benzotriazoles, tetrazoles, mercaptotetrazoles, selenotetrazoles, mercaptothiadiazoles, mercaptotriazoles, mercaptooxadiazoles, telleurotetrazoles, benzisodiazoles, thioureas, purines and other polyazaindenes. These compounds may be prepared by the appropriate methods described within these references. Formulations useful for the purpose of the invention have the desired overall hydrophobicity (as measured by ClogP) and do not cause a significant inhibition of silver development.

In general, heterocyles that contain at least three heteroatoms are preferred. Among the more desirable classes of speed improving heterocycles of this invention are tetrazindenes (including purines), triazoles (including benzotriazoles), tetrazoles, thiadiazoles and oxadiazoles. The minimum ClogP for speed improvement may vary somewhat for each class of compound useful in this invention. Most desirable are purines with a ClogP of at least 6.2, or more preferably at least 6.8 or most suitably at least 7.2; triazoles with a ClogP of at least 8.75, or more preferably at least 9.0 or most suitably at least 9.25 benzotriazoles with a ClogP of at least 7.8, or more preferably at least 8.2 or most suitably at least 9.0; tetrazoles at least 6.5 or more preferably at least 7.0 or most preferably at least 7.5; or thiadiazolcs or oxathiazoles with a ClogP of at least 7.6, or more preferably at least 7.9 or most suitably at least 8.2.

The development promoting agents useful in the invention are not couplers and do not react with oxidized developer (Dox) to generate dyes or any other product. It is desired that the compounds do not undergo any significant amounts (less than 5–10%) of chemical or redox reaction directly with oxidized color developer. They are colorless. They are stable to other components of the processing solutions and do not contain substituents that undergo substantial amounts of chemical reaction in any of the processing solutions.

An important feature of the development promoting agents of the invention is their hydrophobicity which is related to their octanol/water partition coefficient (logP). In order to maximize the photographic effect, the partitioning into water cannot be so low that the material is unable to reach the surface of the emulsion grains. It has also been found that the partitioning into water cannot be too high. Because it can be difficult to measure logP values above 3, a model can be used to compute an estimate of logP, called ClogP that defines the limits of the invention. The model used is MEDCHEM Version 3.54, which is a software program produced by the Medicinal Chemistry Project at Pomona College in California. Calculation methods for ClogP are detailed in U.S. Pat. No. 6,455,242 and U.S. Pat. No. 6,319,660. For the purposes of this invention, the ClogP refers to neutral molecules, even if they would be ionized or protonated (either fully or in part) at the processing pH or at the ambient pH of the photographic film. Thus, in practice, it is highly desirable that the substituents of the compound of the invention do not contain additional very low $pK_a(<7)$ groups such as sulfonic or carboxylic acids nor very basic groups (pKa of conjugate acid <10) such as a tertiary amino group (unless such an amino group is attached to a heterocylic ring such that it is conjugated to a nitrogen atom, in which case its basicity is greatly reduced) since they require an increase in the size and amount in the rest of the hydrophobic substituents in order to meet the overall ClogP requirements.

For each compound of the invention, as the laydown is increased a threshold level is reached following which the improvement gradually increases with laydown, after which the improvement then levels off at a compound specific maximum level. It will be appreciated that the amount is also a function of other variables such as the location and number of layers in which the compound is located, the solvent used, and film dimensions. Thus, it is desirable to have enough laydown of the compound in order to obtain the desired improvement. Typical effective levels range from 0.03 to 0.15 mmole per squared meter coverage, depending on the location of the specific DPA. When the compound is present in a sensitized layer, the ratio of compound to silver is suitably at least 0.4 mmol of compound per mol of silver halide and, more preferably, at least 4.0 mmol of compound per mol of silver halide and, most preferably, between 5–10 mmol per mol of silver halide.

The development promoting agents used in the invention can be added to a mixture containing silver halide before coating or, more suitably, be mixed with the silver halide just prior to or during coating. In either case, additional components like couplers, doctors, surfactants, hardeners and other materials that are typically present in such solutions may also be present at the same time. The materials are not water-soluble and cannot be added directly to the solution. They may be added directly if dissolved in an organic water miscible solution such as methanol, acetone or the like or more preferably as a dispersion. A dispersion incorporates the material in a stable, finely divided state in a hydrophobic organic solvent (often referred to as a coupler solvent or permanent solvent) that is stabilized by suitable surfactants and surface active agents usually in combination with a binder or matrix such as gelatin. The dispersion may contain one or more permanent solvents that dissolve the material and maintain it in a liquid state. Some examples of suitable permanent solvents are tricresylphosphate, N,N-diethyllauramide, N,N-dibutyllauramide, p-dodecylphenol, dibutylphthalate, di-n-butyl sebacate, N-n-butylacetanilide, 9-octadecen-1-ol, ortho-methylphenyl benzoate, trioctylamine and 2-ethylhexylphosphate. Permanent solvents can also be described in terms of physical constants such as alpha, beta and pi* as defined by M. J. Kamlet, J-L. M. Abboud, M. H. Abraham and R. W. Taft, J. Org Chem, 48, 2877(1983). The preferred permanent solvents used with the materials of the invention are those with ClogP of 5.0 or greater and beta values of 0.4 or greater or more preferably, beta values of 0.5 or greater. Preferred classes of solvents are carbonamides, phosphates, alcohols and esters. When a solvent is present, it is preferred that the weight ratio of compound to solvent be at least 1 to 0.5, or most preferably, at least 1 to 1. The dispersion may require an auxiliary coupler solvent initially to dissolve the component but this is removed afterwards, usually either by evaporation or by washing with additional water. Some examples of suitable auxiliary coupler solvents are ethyl acetate, cyclohexanone and 2-(2-butoxyethoxy)ethyl acetate. The dispersion may also be stabilized by addition of polymeric materials to form stable latexes. Examples of suitable polymers for this use generally contain water-solubilizing groups or have regions of high hydrophilicity. Some examples of suitable dispersing agents or surfactants are Alkanol XC or saponin. The materials used in the invention may also be dispersed as an admixture with another component of the system such as a coupler or an oxidized developer scavenger so that both are present in the same oil droplet. It is also possible to incorporate the materials of the invention as a solid particle dispersion; that is, a slurry or suspension of finely ground (through mechanical means) compound. These solid particle dispersions may be additionally stabilized with surfactants and/or polymeric materials as known in the art. Also, additional permanent solvent may be added to the solid particle dispersion to help increase activity.

The following are examples of DPA compounds, along with the corresponding ClogP values, that are useful in this invention:

DPA-1: (6.91)

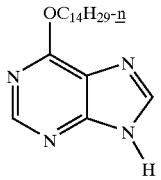

DPA-2: (8.32)

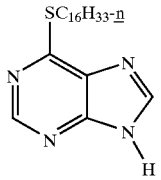

DPA-3: (7.84)

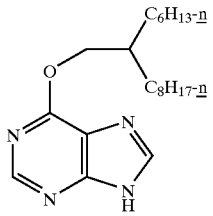

-continued

DPA-4: (6.98)

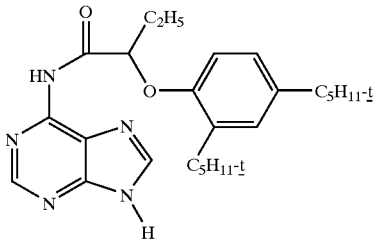

DPA-5: (7.99)

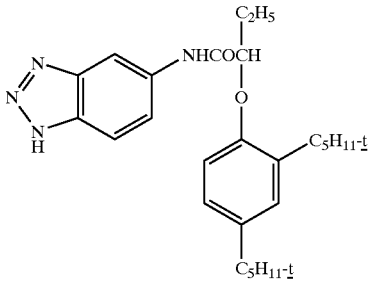

DPA-6: (10.66)

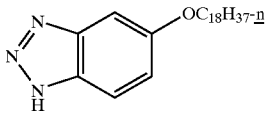

DPA-7: (12.07)

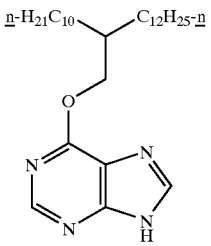

DPA-8: (10.23)

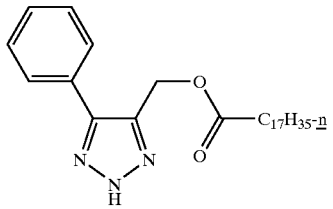

DPA-9: (9.04)

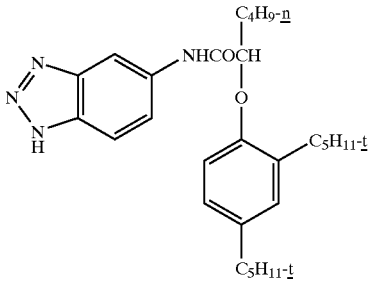

DPA-10: (10.84)

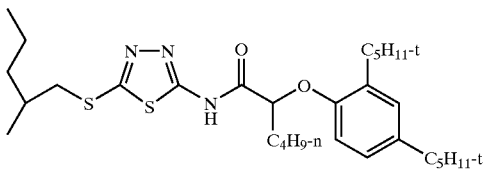

-continued

DPA-11: (10.12)

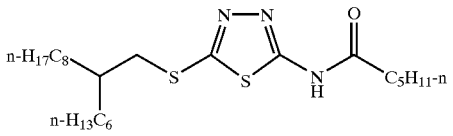

DPA-12: (9.91)

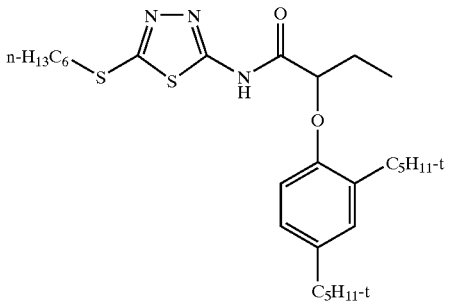

In another embodiment, certain couplers are added to the layer of highest sensitivity which also comprises a dye layered emulsion. Particularly useful for this embodiment are pyrazolotriazole couplers, with coupler of Formula IIIa being most useful. The magenta image couplers useful in this invention are two equivalent 5-pyrazolones such as those described in U.S. Pat. No. 5,262,292; U.S. Pat. No. 5,389,504; U.S. Pat. No. 5,200,309; U.S. Pat. No. 5,250,405; U.S. Pat. No. 5,256,528; U.S. Pat. No. 5,350,667; U.S. Pat. No. 5,376,519; U.S. Pat. No. 5,441,851; U.S. Pat. No. 5,462,848; U.S. Pat. No. 5,667,946; DE 19516166; JP 02151857; U.S. Pat. No. 6,218097; and DE 19525666; or two equivalent pyrazolotriazole couplers such as those described in U.S. Pat. No. 5,389,504; U.S. Pat. No. 5,985,532; U.S. Pat. No. 5,256,529; U.S. Pat. No. 5,270,156; U.S. Pat. No. 5,236,819; U.S. Pat. No. 5,118,591; U.S. Pat. No. 4,959,300 and U.S. Pat. No. 4,880,733. These couplers may be prepared by the appropriate methods described within these references.

Two equivalent 3-amido-5-pyrazolones are preferably according to Formula (I):

(Formula I)

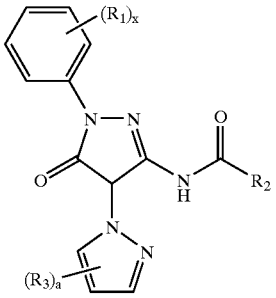

where $R_1$ and $R_3$ are independently selected from alkyl, aryl, alkoxy or aryloxy, alkylthio or arylthio, sulfoxyl, sulfonyl, sulfamoyl

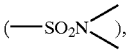

halo such as fluoro, chloro, bromo or iodo, cyano, thiol, hydroxy, nitro, —O—CO—, —O—$SO_2$—, a heterocyclic group such as furanyl or morpholino, a carbonyl group such as keto, carboxylic acid (—$CO_2$H), carboxylate ester (—$CO_2$—) or carbarmoyl

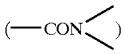

or an amino group such as a primary, secondary or tertiary substituted nitrogen, carbonamido (>NCO—) or sulfonamido (>$NSO_2$—); $R_2$ is an alkyl or aryl group; x is 1–5 and a is 1–3. More preferred couplers are where $R_3$ is hydrogen.

The two equivalent 3-anilino-5-pyrazolones are preferably according to Formula (II):

(Formula II)

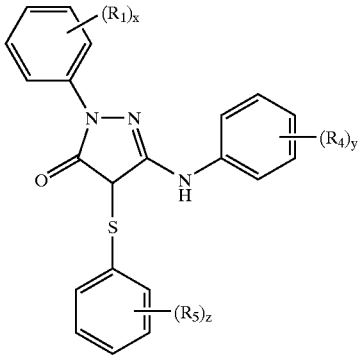

where $R_4$ and $R_5$ are independently defined the same as $R_1$ and x, y and z are independently 1–5.

The most preferable 3-anilino-5-pyrazolones are according to Formula (IIa):

(Formula IIa)

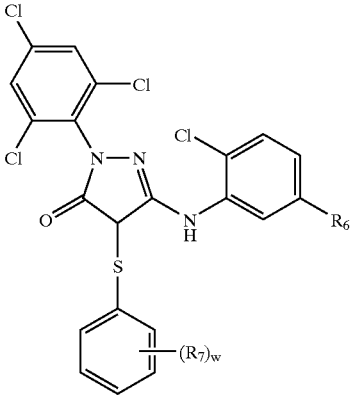

where $R_6$ is an amino, carbamoyl group, sulfamoyl, or carbonyl group that contains at least 8 carbon atoms and $R_7$ is selected from an amino, carbamoyl, alkyl or alkyloxy group with w=1 or 2 (if w=2, $R_7$ can be the same or different).

Some examples of 2 equivalent 5-pyrazolone magenta couplers useful in the invention are:
MC-1:
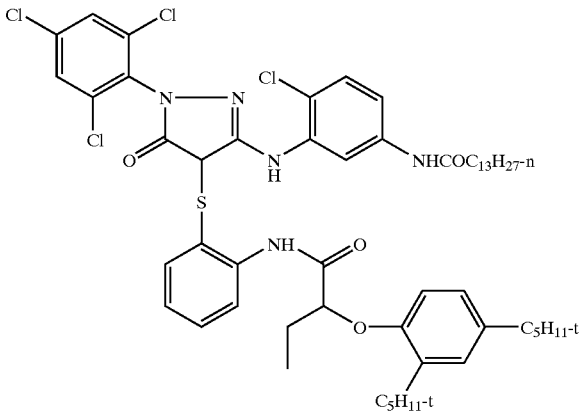
MC-2:
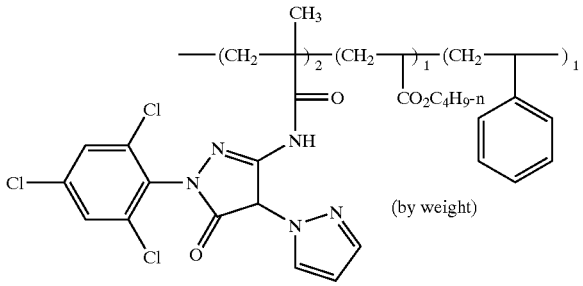
(by weight)
MC-3:
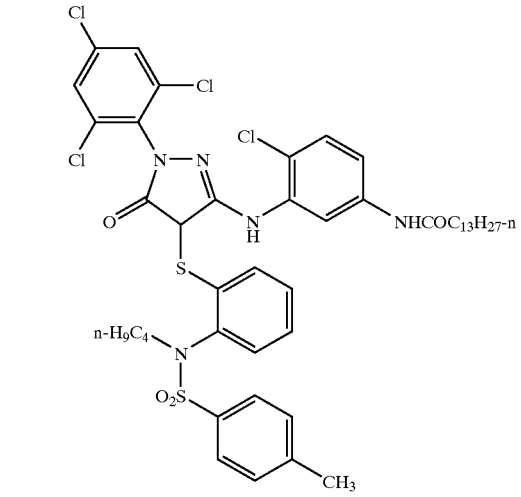
-continued
MC-4:
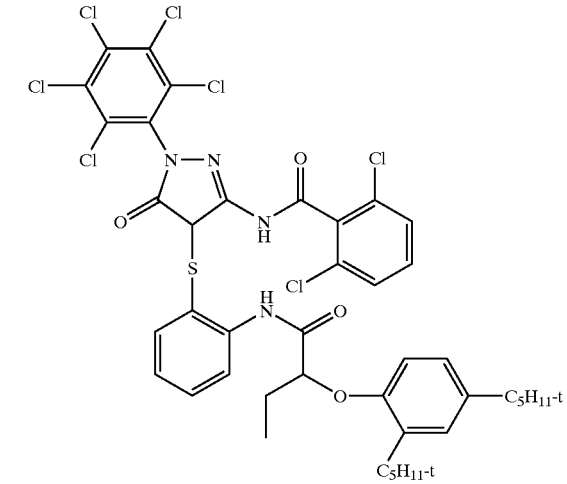
MC-5:
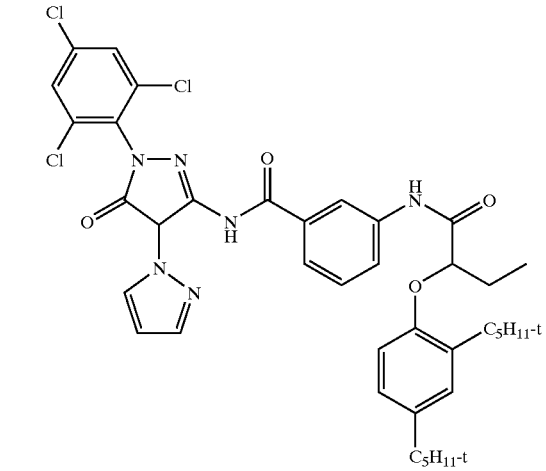
Preferred two equivalent pyrazolotriazole couplers can be either according to Formulas IIIa or IIIb:
(Formula IIIa)
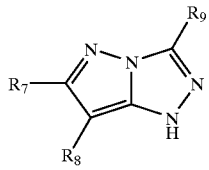
(Formula IIIb)
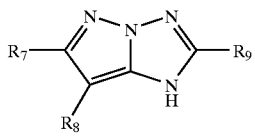

where $R_7$ is an alkyl, aryl, alkyloxy or aryloxy group, $R_8$ is any coupling group known in the art and $R_9$ is an alkyl or aryl group containing at least 8 carbon atoms.

More preferred pyrazolotriazole couplers according to Formula IIIa are according to Formula IIIa1:

(Formula IIIa1)

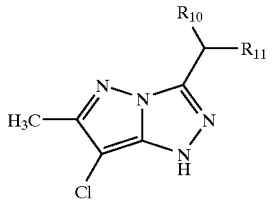

where $R_{10}$ is an alkyl or aryl group and $R_{11}$ is nitrogen or oxygen. More preferred couplers according to Formula IIIb are according to Formula IIIb1:

(Formula IIIb1)

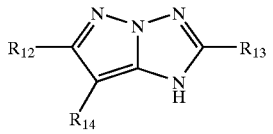

where $R_{12}$ is an alkyl or alkyloxy group; $R_{13}$ is an alkyl or aryl group; and $R_{14}$ is a chloro, aryloxy or pyrazole group.

Some examples of 2 equivalent pyrazolotriazole magenta couplers useful in the invention are:

MC-6:

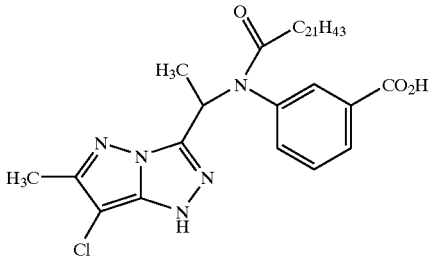

MC-7:

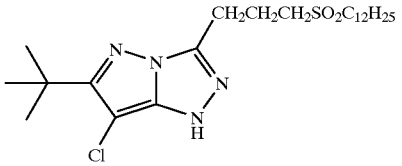

MC-8:

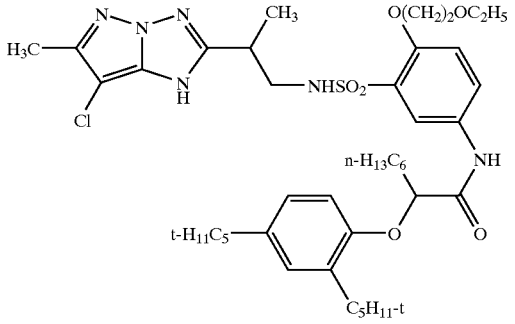

-continued

MC-9:

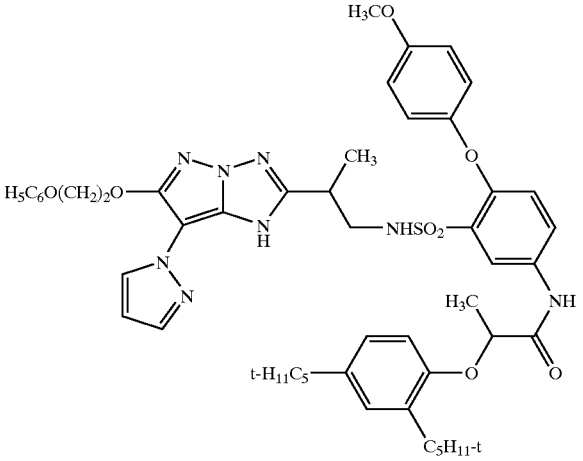

MC-10:

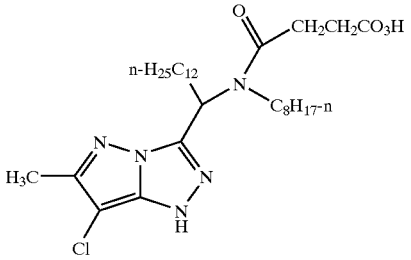

MC-11:

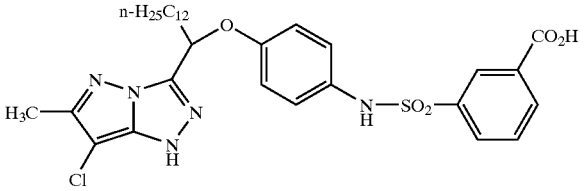

MC-12:

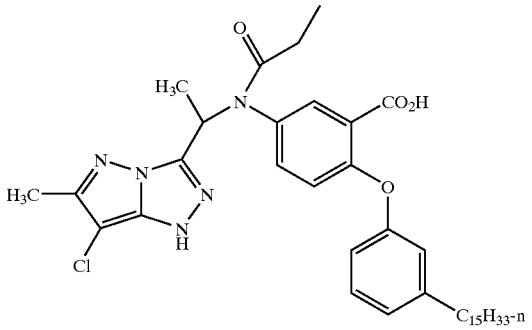

For the purposes of this invention, it is highly desirable to maximize the reactivity of the two equivalent magenta couplers towards oxidized developer. In particular, it is preferred that the two equivalent 5-pyrazolone couplers are dispersed in at least its own weight in a permanent solvent and optionally may contain an additional aniline or nitrogen heterocycle to minimize bleach induced density formation (as known as continued coupling) as known in the art. Some examples of suitable permanent solvents for either class of magenta coupler are tricresylphosphate, N,N-diethyllauramide, N,N-dibutyllauramide, p-dodecylphenol, dibutylphthalate, di-n-butyl sebacate, N-n-butylacetanilide, 9-octadecen-1-ol, ortho-methylphenyl benzoate, trioctylamine and 2-ethylhexylphosphate. Preferred classes of solvents are carbonamides, phosphates, alcohols and esters. The laydown of the magenta image coupler is not critical but will depend on the activity and type of coupler. It is understood that the laydown should be suitable to obtain the desired density and speed, but for most applications, the laydown will not exceed 0.4 mmoles/$m^2$. Moreover, when a number of layers of the same spectral sensitivity but of differing degrees of sensitivity to light are used, it is known that overall granularity can be minimized by using a smaller molar amount of dye-formning coupler than silver in the layers of higher sensitivity. Thus, it is preferred that the layers containing the magenta coupler of the invention additionally contain less than a stoichiometric amount of total dye forming coupler(s) relative to the amount of silver contained in the same layer. A suitable molar ratio of dye-forming coupler(s) to silver in the layer containing the dye layered emulsion would be less than 0.5. More preferred would be a ratio of 0.1 or less and most preferred would be a ratio of 0.05 or less.

In a more preferred embodiment of the invention additional improvements may be realized by using a development promoting agent in combination with one of the couplers described above. The combination is used in the layer of highest sensitivity which further comprises a dye layered silver halide emulsion as described above.

Unless otherwise specifically stated, use of the term "substituted" or "substituent" means any group or atom other than hydrogen. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecyl amino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecylphenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3- to 7-membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. When a molecule may have two or more substituents, the substituents may be joined together to form a ring such as a fused ring unless otherwise provided. Generally, the above groups and substituents thereof may include those having up to 48 carbon atoms, typically 1 to 36 carbon atoms and usually less than 24 carbon atoms, but greater numbers are possible depending on the particular substituents selected.

When the term "associated" is employed, it signifies that a reactive compound is in or adjacent to a specified layer where, during processing, it is capable of reacting with other components.

To control the migration of various components, it may be desirable to include a high molecular weight hydrophobe or "ballast" group in coupler molecules. Representative ballast groups include substituted or unsubstituted alkyl or aryl groups containing 8 to 42 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arysulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. In one embodiment of the invention the emulsion containing the dye layered grains containing the antenna dye described herein is in the magenta dye forming unit. Particularly useful is a silver halide photographic element wherein the silver halide photographic element further comprises a yellow filter dye in a layer between the support and the green sensitized layer closest to the support. A preferred dye is show below.

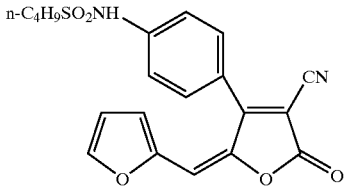

YFD-1

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire PO10 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230, provides suitable embodiments. A particularly useful support for small format film is annealed polyethylenenaphthlate.

In the following discussion of suitable materials for use in the emulsions and elements of this invention, reference will be made to *Research Disclosure*, September 1996, Item 38957, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. More preferably the elements are negative working. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. Certain desirable photographic elements and processing steps are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl such as oxazolidinyl or hydantoinyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, 4,540,654, and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized and color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine LiteratureUbersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: U.K. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; U.K. Patent 1,530,272; and Japanese Application 58-113935. The masking couplers may be shifted or blocked, if desired.

Typically, couplers are incorporated in a silver halide emulsion layer in a mole ratio to silver of 0.05 to 1.0 and generally 0.1 to 0.5. Usually the couplers are dispersed in a high-boiling organic solvent in a weight ratio of solvent to coupler of 0.1 to 10.0 and typically 0.1 to 2.0 although dispersions using no permanent coupler solvent are sometimes employed.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g., as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles.

In a preferred embodiment, the inhibitor moiety or group is selected from the following formulas:

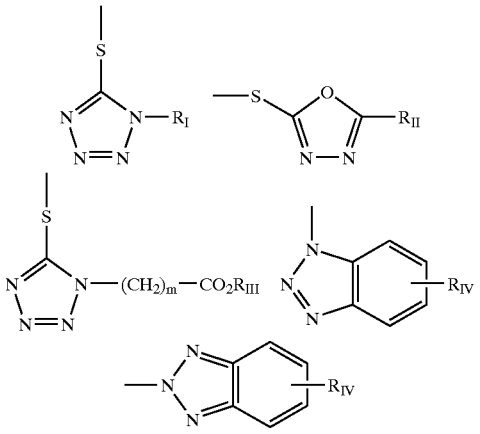

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. No. 4,438,193; U.S. Pat. No. 4,618,571) and groups that combine the features describe above. It is typical that the timing group is of one of the formulas:

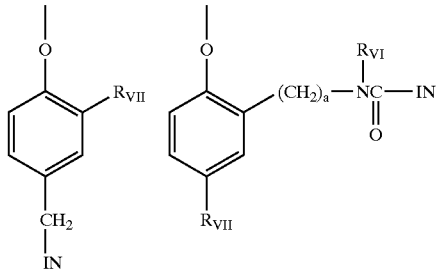

wherein IN is the inhibitor moiety, $R_{VII}$ is selected from the group consisting of nitro, cyano, alkylsulfonyl; sulfamoyl; and sulfonamido groups; a is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

D1

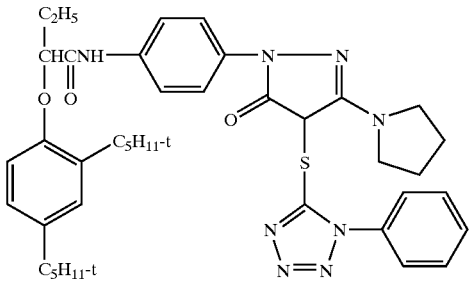

D2

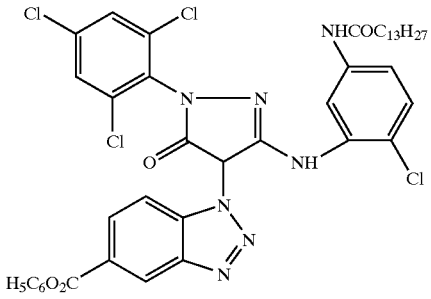

D3

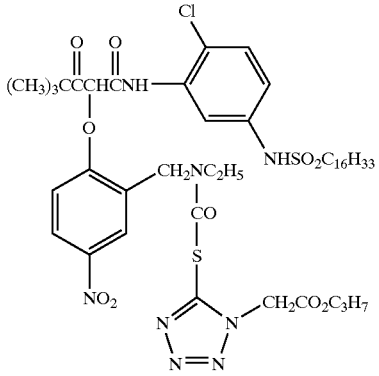

-continued
D4
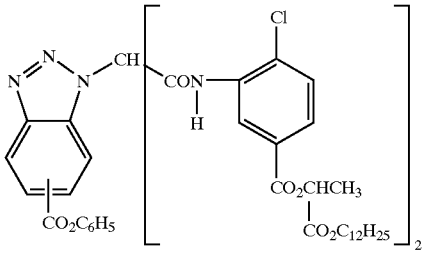
D5
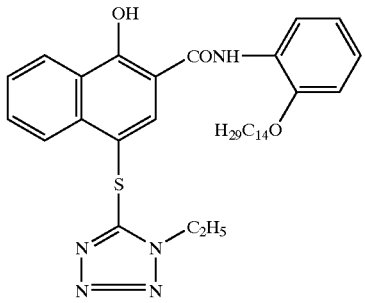
D6
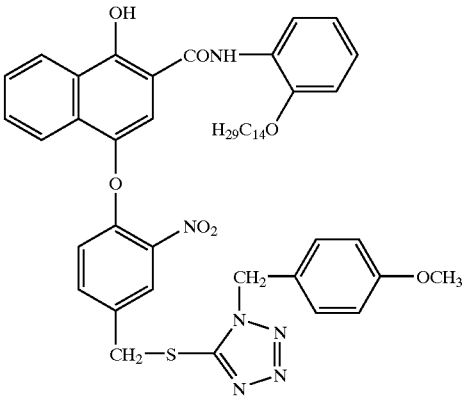
D7
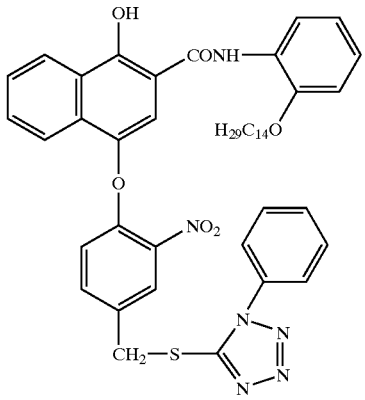
-continued
D8
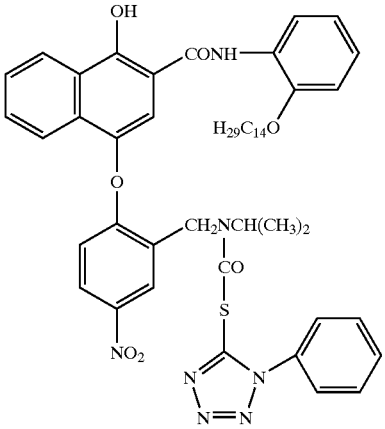
D9
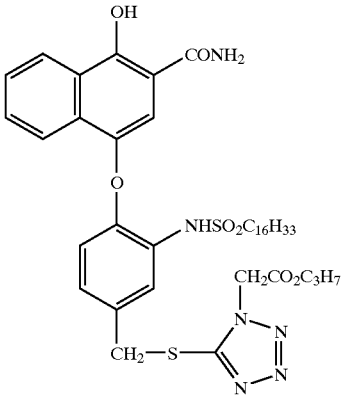
D10
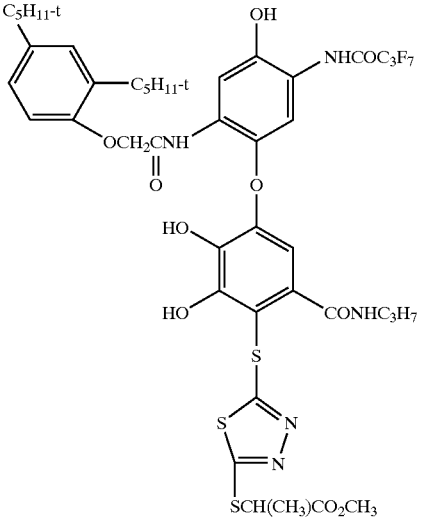

-continued

D11

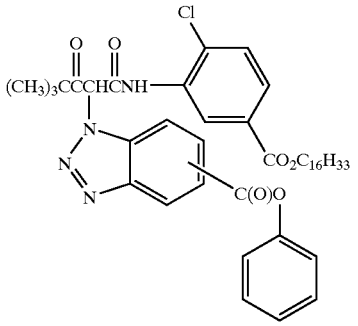

D12

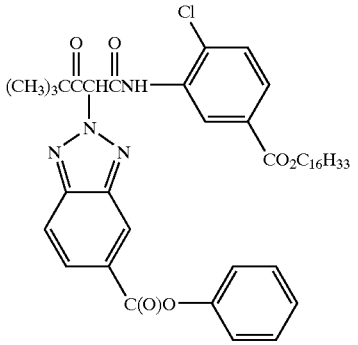

The silver halide used in the photographic elements may be silver iodobromide, silver bromide, silver chloride, silver chlorobromide, silver chloroiodobromide, and the like. The grain size of the silver halide may have any distribution known to be useful in photographic compositions, and may be either polydispersed or monodispersed.

The silver halide grains to be used in the invention may be prepared according to methods known in the art, such as those described in *Research Disclosure I* and *The Theory of the Photographic Process*, $4^{th}$ edition, T. H. James, editor, Macmillan Publishing Co., New York, 1977. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

Especially useful in this invention are radiation-sensitive tabular grain silver halide emulsions. Tabular grains are silver halide grains having parallel major faces and an aspect ratio of at least 2, where aspect ratio is the ratio of grain equivalent circular diameter (ECD) divided by grain thickness (t). The equivalent circular diameter of a grain is the diameter of a circle having an average equal to the projected area of the grain. A tabular grain emulsion is one in which tabular grains account for greater than 50 percent of total grain projected area. In preferred tabular grain emulsions tabular grains account for at least 70 percent of total grain projected area and optimally at least 90 percent of total grain projected area. It is possible to prepare tabular grain emulsions in which substantially all (>97%) of the grain projected area is accounted for by tabular grains. The non-tabular grains in a tabular grain emulsion can take any convenient conventional form. When coprecipitated with the tabular grains, the non-tabular grains typically exhibit a silver halide composition as the tabular grains.

The tabular grain emulsions can be either high bromide or high chloride emulsions. High bromide emulsions are those in which silver bromide accounts for greater than 50 mole percent of total halide, based on silver. High chloride emulsions are those in which silver chloride accounts for greater than 50 mole percent of total halide, based on silver. Silver bromide and silver chloride both form a face centered cubic crystal lattice structure. This silver halide crystal lattice structure can accommodate all proportions of bromide and chloride ranging from silver bromide with no chloride present to silver chloride with no bromide present. Thus, silver bromide, silver chloride, silver bromochloride and silver chlorobromide tabular grain emulsions are all specifically contemplated. In naming grains and emulsions containing two or more halides, the halides are named in order of ascending concentrations. Usually high chloride and high bromide grains that contain bromide or chloride, respectively, contain the lower level halide in a more or less uniform distribution. However, non-uniform distributions of chloride and bromide are known, as illustrated by Maskasky U.S. Pat. Nos. 5,508,160 and 5,512,427 and Delton U.S. Pat. Nos. 5,372,927 and 5,460,934, the disclosures of which are here incorporated by reference.

It is recognized that the tabular grains can accommodate iodide up to its solubility limit in the face centered cubic crystal lattice structure of the grains. The solubility limit of iodide in a silver bromide crystal lattice structure is approximately 40 mole percent, based on silver. The solubility limit of iodide in a silver chloride crystal lattice structure is approximately 11 mole percent, based on silver. The exact limits of iodide incorporation can be somewhat higher or lower, depending upon the specific technique employed for silver halide grain preparation. In practice, useful photographic performance advantages can be realized with iodide concentrations as low as 0.1 mole percent, based on silver. It is usually preferred to incorporate at least 0.5 (optimally at least 1.0) mole percent iodide, based on silver. Only low levels of iodide are required to realize significant emulsion speed increases. Higher levels of iodide are commonly incorporated to achieve other photographic effects, such as interimage effects. Overall iodide concentrations of up to 20 mole percent, based on silver, are well known, but it is generally preferred to limit iodide to 15 mole percent, more preferably 10 mole percent, or less, based on silver. Higher than needed iodide levels are generally avoided, since it is well recognized that iodide slows the rate of silver halide development.

Iodide can be uniformly or non-uniformly distributed within the tabular grains. Both uniform and non-uniform iodide concentrations are known to contribute to photographic speed. For maximum speed it is common practice to distribute iodide over a large portion of a tabular grain while increasing the local iodide concentration within a limited portion of the grain. It is also common practice to limit the concentration of iodide at the surface of the grains. Preferably the surface iodide concentration of the grains is less than 5 mole percent, based on silver. Surface iodide is the iodide that lies within 0.02 nm of the grain surface.

With iodide incorporation in the grains, the high chloride and high bromide tabular grain emulsions within the contemplated of the invention extend to silver iodobromide, silver iodochloride, silver iodochlorobromide and silver iodobromochloride tabular grain emulsions.

When tabular grain emulsions are spectrally sensitized, as herein contemplated, it is preferred to limit the average thickness of the tabular grains to less than 0.3 $\mu$m. Most preferably the average thickness of the tabular grains is less than 0.2 $\mu$m. In a specific preferred form the tabular grains are ultrathin-that is, their average thickness is less than 0.07 $\mu$m.

The useful average grain ECD of a tabular grain emulsion can range up to about 15 μm. Except for a very few high speed applications, the average grain ECD of a tabular grain emulsion is conventionally less than 10 μm, with the average grain ECD for most tabular grain emulsions being less than 5 μm.

The average aspect ratio of the tabular grain emulsions can vary widely, since it is quotient of ECD divided by grain thickness. Most tabular grain emulsions have average aspect ratios of greater than 5, with high (>8) average aspect ratio emulsions being generally preferred. Average aspect ratios ranging up to 50 are common, with average aspect ratios ranging up to 100 and even higher, being known.

The tabular grains can have parallel major faces that lie in either {100} or {111} crystal lattice planes. In other words, both {111} tabular grain emulsions and {100} tabular grain emulsions are within the specific contemplation of this invention. The {111} major faces of {111} tabular grains appear triangular or hexagonal in photomicrographs while the {100} major faces of {100} tabular grains appear square or rectangular.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, Maskasky et al U.S. Pat. Nos. 5,176,992 and 5,178,998, Takada et al U.S. Pat. No. 4,783,398, Nishikawa et al U.S. Pat. No. 4,952,508, Ishiguro et al U.S. Pat. No. 4,983,508, Tufano et al U.S. Pat. No. 4,804,62 1, Maskasky and Chang U.S. Pat. No. 5,178,998, and Chang et al U.S. Pat. No. 5,252,452. Ultrathin high chloride {111} tabular grain emulsions are illustrated by Maskasky U.S. Pat. Nos. 5,271,858 and 5,389,509.

Since silver chloride grains are most stable in terms of crystal shape with {100} crystal faces, it is common practice to employ one or more grain growth modifiers during the formation of high chloride {111} tabular grain emulsions. Typically the grain growth modifier is displaced prior to or during subsequent spectral sensitization, as illustrated by Jones et al U.S. Pat. No. 5,176,991 and Maskasky U.S. Pat. Nos. 5,176,992, 5,221,602, 5,298,387 and 5,298,388, the disclosures of which are here incorporated by reference.

Preferred high chloride tabular grain emulsions are {100} tabular grain emulsions, as illustrated by the following patents, here incorporated by reference: Maskasky U.S. Pat. Nos. 5,264,337, 5,292,632, 5,275,930, 5,607,828 and 5,399,477, House et al U.S. Pat. No. 5,320,938, Brust et al U.S. Pat. No. 5,314,798, Szajewski et al U.S. Pat. No. 5,356,764, Chang et al U.S. Pat. Nos. 5,413,904, 5,663,041, and 5,744,297, Budz et al U.S. Pat. No. 5,451,490, Reed et al U.S. Pat. No. 5,695,922, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above. Since high chloride {100} tabular grains have {100} major faces and are, in most instances, entirely bounded by {100} grain faces, these grains exhibit a high degree of grain shape stability and do not require the presence of any grain growth modifier for the grains to remain in a tabular form following their precipitation.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501, 4,463,087, 4,173,320 and 5,411,851 5,418,125, 5,492,801, 5,604,085, 5,620,840, 5,693,459, 5,733,718, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, '772, '773, 5,171,659 and 5,252,453, Black et al U.S. Pat. Nos. 5,219,720 and 5,334,495, Delton U.S. Pat. Nos. 5,310,644, 5,372,927 and 5,460,934, Wen U.S. Pat. No. 5,470,698, Fenton et al U.S. Pat. No. 5,476,760, Eshelman et al U.S. Pat. Nos. 5,612,175, 5,612,176 and 5,614,359, and Irving et al U.S. Pat. Nos. 5,695,923, 5,728,515 and 5,667,954, Bell et al U.S. Pat. No. 5,132,203, Brust U.S. Pat. Nos. 5,248,587 and 5,763,151,. Chaffee et al U.S. Pat. No. 5,358,840, Deaton et al U.S. Pat. No. 5,726,007, King et al U.S. Pat. No. 5,518,872, Levy et al U.S. Pat. No. 5,612,177, Mignot et al U.S. Pat. No. 5,484,697, Olm et al U.S. Pat. No. 5,576,172, Reed et al U.S. Pat. Nos. 5,604,086 and 5,698,387.

Ultrathin high bromide {111 } tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955. High bromide {100} tabular grain emulsions are illustrated by Mignot U.S. Pat. Nos. 4,386,156 and 5,386,156.

High bromide {100} tabular grain emulsions are known, as illustrated by Mignot U.S. Pat. No. 4,386,156 and Gourlaouen et al U.S. Pat. No. 5,726,006.

In many of the patents listed above (starting with Kofron et al, Wilgus et al and Solberg et al, cited above) speed increases without accompanying increases in granularity are realized by the rapid (a.k.a. dump) addition of iodide for a portion of grain growth. Chang et al U.S. Pat. No. 5,314,793 correlates rapid iodide addition with crystal lattice disruptions observable by stimulated X-ray emission profiles.

Localized peripheral incorporations of higher iodide concentrations can also be created by halide conversion. By controlling the conditions of halide conversion by iodide, differences in peripheral iodide concentrations at the grain corners and elsewhere along the edges can be realized. For example, Fenton et al U.S. Pat. No. 5,476,76 discloses lower iodide concentrations at the corners of the tabular grains than elsewhere along their edges. Jagannathan et al U.S. Pat. Nos. 5,723,278 and 5,736,312 disclose halide conversion by iodide in the corner regions of tabular grains.

Crystal lattice dislocations, although seldom specifically discussed, are a common occurrence in tabular grains. For example, examinations of the earliest reported high aspect ratio tabular grain emulsions (e.g., those of Kofron et al, Wilgus et al and Solberg et al, cited above) reveal high levels of crystal lattice dislocations. Black et al U.S. Pat. No. 5,709,988 correlates the presence of peripheral crystal lattice dislocations in tabular grains with improved speed-granularity relationships. Ikeda et al U.S. Pat. No. 4,806,461 advocates employing tabular grain emulsions in which at least 50 percent of the tabular grains contain or more dislocations. For improving speed-granularity characteristics, it is preferred that at least 70 percent and optimally at least 90 percent of the tabular grains contain 10 or more peripheral crystal lattice dislocations.

The silver halide emulsion may comprise tabular silver halide grains having surface chemical sensitization sites including at least one silver salt forming epitaxial junction with the tabular grains and being restricted to those portions of the tabular grains located nearest peripheral edges.

The silver halide tabular grains of the photographic material may be prepared with a maximum surface iodide concentration along the edges and a lower surface iodide concentration within the corners than elsewhere along the edges.

In the course of grain precipitation one or more dopants (grain occlusions other than silver and halide) can be introduced to modify grain properties. For example, any of the various conventional dopants disclosed in *Research Disclosure*, Item 38957, Section I. Emulsion grains and their preparation, sub-section G. Grain modifying conditions and adjustments, paragraphs (3), (4) and (5), can be present in the emulsions of the invention. Especially useful dopants are disclosed by Marchetti, et al., U.S. Pat. No. 4,937,180, and Johnson, et al., U.S. Pat. No. 5,164,292. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in Research Disclosure Item 36736 published November 1994, here incorporated by reference.

SET dopants are known to be effective to reduce reciprocity failure. In particular the use of $Ir^{+3}$ or $Ir^{+4}$ hexacoordination complexes as SET dopants is advantageous.

Iridium dopants that are ineffective to provide shallow electron traps (non-SET dopants) can also be incorporated into the grains of the silver halide grain emulsions to reduce reciprocity failure.

The contrast of the photographic element can be further increased by doping the grains with a hexacoordination complex containing a nitrosyl or thionitrosyl ligand (NZ dopants) as disclosed in McDugle et al U.S. Pat. No. 4,933,272, the disclosure of which is here incorporated by reference.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. One type of such element, referred to as a color negative film, is designed for image capture. Preferably the materials of the invention are color negative films. Speed (the sensitivity of the element to low light conditions) is usually critical to obtaining sufficient image in such elements. Such elements are typically silver bromoiodide emulsions coated on a transparent support and are sold packaged with instructions to process in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3' 15" or less and desirably 90 or even 60 seconds or less.

The photographic element of the invention can be incorporated into exposure structures intended for repeated use or exposure structures intended for limited use, variously referred to by names such as "one time use camera", "single use cameras", "lens with film", or "photosensitive material package units".

Another type of color negative element is a color print. Such an element is designed to receive an image optically printed from an image capture color negative element. A color print element may be provided on a reflective support for reflective viewing (e.g., a snapshot) or on a transparent support for projection viewing as in a motion picture. Elements destined for color reflection prints are provided on a reflective support, typically paper, employ silver chloride emulsions, and may be optically printed using the so-called negative-positive process where the element is exposed to light through a color negative film which has been processed as described above. The element is sold packaged with instructions to process using a color negative optical printing process, for example, the Kodak RA-4 process, as generally described in PCT WO 87/04534 or U.S. Pat. No. 4,975,357, to form a positive image. Color projection prints may be processed, for example, in accordance with the Kodak ECP-2 process as described in the H-24 Manual. Color print development times are typically 90 seconds or less and desirably 45 or even 30 seconds or less.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride and 4-amino-N-ethyl-N-2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the patents and other publications cited in this specification are incorporated herein by reference. The following example is intended to illustrate, but not to limit the invention:

EXAMPLES

Example 1

Emulsion E-1, (Comparative)

The emulsion, E-1, used in the multilayer examples was a sulfur-and-gold sensitized 2.90 $\mu$m×0.13 $\mu$m silver iodobromide tabular emulsion containing 3.7 mole % iodide added at 74% of the total silver and containing sodium selenocyanate (1.39 μmole/Ag mole) and potassium hexacyanoruthenate (25 μmole/Ag mole) added at 67% of the total silver. The emulsion was heated to 43.3° C., after which sodium thiocyanate (100 mg/Ag mole) was added. After a 5' hold, 3-(2-methylsulfamoylethyl)-benzothiazolium tetrafluoroborate (35 mg/Ag mole) was added followed by a 2' hold. Then the first sensitizing dye, GSD-1, (475.5 mg/Ag mole) was added. After a 10' hold, the second sensitizing dye, GSD-2, (110 mg/Ag mole) was added with a subsequent 20' hold. This was followed by the addition of sodium aurous dithiosulfate dihydrate (1.9 mg/Ag mole). After a 2' hold, sodium thiosulfate pentahydrate (0.84 mg/Ag mole) was added, followed by a 2' hold. The emulsion was held for 15' at 60° C. After cooling to 40° C., 1-(3-acetamidophenyl)-5-mercaptotetrazole (11.4 mg/Ag mole) was added. The emulsion was held for 2' at 40° C. and then cooled to 35° C. and chill set.

Emulsion E-2 (Invention)

The dye-layered emulsion, E-2, used in the multilayer examples was a sulfur-and-gold sensitized 2.20 μm×0.125 μm silver iodobromide tabular emulsion containing 4.5 mole % iodide added at 74% of the total silver and containing sodium selenocyanate (1.39 μmole/Ag mole) and potassium hexacyanoruthenate (25 μmole/Ag mole) added at 67% of the total silver. The emulsion was heated to 43° C., after which sodium thiocyanate (100 mg/Ag mole) was added. After a 5' hold, 3-(2-methylsulfamoylethyl)-benzothiazolium tetrafluoroborate (35 mg/Ag mole) was added followed by a 2' hold. Then the first sensitizing dye GSD-1 (543 mg/Ag mole) was added. After a 20' hold, the second sensitizing dye GSD-2 (99 mg/Ag mole) was added with a subsequent 20' hold. This was followed by the addition of sodium aurous dithiosulfate dihydrate (2.0 mg/Ag mole). After a 2' hold, sodium thiosulfate pentahydrate (1.0 mg/Ag mole) was added, followed by a 2' hold. The emulsion was held for 22' at 60° C. After cooling to 43° C., 1-3-acetamidophenyl)-5-mercaptotetrazole (25 mg/Ag mole) was added with a subsequent 2' hold. Then the GSD-3 layering dye was added (1.2 mmole/Ag mole) followed by a 30' hold. Next, benzenesulfonic acid, 2,5-dihydroxy-4-(1-methylheptadecyl-,monosodium salt) (250 mg/Ag mole) was added followed by a 2' hold. Then, butanedioic acid, sulfo-1,4-bis(2-ethylhexyl) ester, sodium salt (1500 mg/Ag mole) was added with a subsequent 5' hold. Following the hold, 4-hydroxy-6-methyl-1,3,3a,7-tetraazaindene, sodium salt, monohydrate, (1 g/Ag mole) was added and then held for 5'. The melt was subsequently cooled to 35° C. and chill set.

Multilayer Sample A-1

The multilayer film structure utilized for this example is shown below, with structures of components provided at the end of the example section. The coating support was cellulose triacetate. Component laydowns are in grams per meter squared and emulsion sizes are reported in diameter× thickness in microns. 1,1'-(methylene bis(sulfonyl))bisethene hardener was used at 1.8% of total gelatin weight. Antifoggants (including 4-hydroxy-6-methyl-1,3,3a,7-tetraazaindene), surfactants, coating aids, coupler solvents, emulsion addenda, sequesterants, lubricants, matte and tinting dyes were added to the appropriate layers as is common in the art. Layers are numbered beginning with the layer furthest from the support. Layer 7 was the experimental layer varied in multilayer samples A-2 through A-4. The development promoting agent, DPA-3, was removed from Layer 6 in all samples where it was coated in Layer 7.

Layer 1 (Protective Overcoat Layer): gelatin at 0.87.

Layer 2 (UV Filter Layer): silver bromide Lippman emulsion at 0.215, UV-1 at 0.105, UV-2 at 0.105, ADD-01 at 0.0014, and gelatin at 0.69.

Layer 3 (Fast Yellow Layer): a blend of a blue sensitized (with a mixture of BSD-1 and BSD-2) tabular silver iodobromide emulsion, 2.7×0.13 μm, 4.1 mole % iodide at 0.32, and a blue sensitized (with BSD-2) three-dimensional silver iodobromide emulsion, 1.2 μm, 9.7 mole % iodide at 0.68. Yellow dye-forming coupler YC-1 at 0.256, IR-1 at 0.084, bleach-accelerator releasing coupler B-1 at 0.0064 and gelatin at 0.864.

Layer 4 (Mid Yellow Layer): a blend of two blue sensitized (both with a mixture of BSD-1 and BSD-2) tabular silver iodobromide emulsions: (i) 1.3×0.14 μm, 4.1 mole % iodide at 0.277 and (ii) 0.99×0.14 μm, 1.4 mole % iodide at 0.243. Yellow dye-forming couplers YC-1 at 1.008, IR-1 at 0.08, and gelatin at 1.658.

Layer 5 (Slow Yellow Layer): a blend of two blue sensitized (both with a mixture of BSD-1 and BSD-2) tabular silver iodobromide emulsions: (i) 0.99×0.14 μm, 1.4 mole % iodide at 0.136 and (ii) 0.5×0.08 μm, 1.3 mole % iodide at 0.28. Yellow dye-forming couplers YC-1 at 0.160 and YC-2 at 0.104, IR-2 at 0.036, bleach-accelerator releasing coupler B-1 at 0.0064, and gelatin at 1.076.

Layer 6 (Interlayer): OxDS-1 at 0.088, DPA-3 at 0.032, ADD-02 at 0.0027, and gelatin at 0.8.

Layer 7 (Fast Magenta Layer): a green sensitized iodobromide tabular emulsion, E-1, at 1.04, magenta dye-forming coupler MC-1 at 0.174, masking coupler MM-1 at 0.048, IR-3 at 0.036, and gelatin at 1.277.

Layer 8 (Mid Magenta Layer): a blend of two green sensitized (with a mixture of GSD-1 and GSD-2) silver iodobromide tabular emulsions: (i) 2.3×0.13 μm, 4.5 mole % iodide at 0.275 and (ii) 1.3×0.13 μm, 4.5 mole % iodide at 0.605. Magenta dye-forming coupler MC-1 at 0.244, masking coupler MM-1 at 0.112, IR-3 at 0.016, IR-4 at 0.027, and gelatin at 1.639.

Layer 9 (Slow magenta layer): a blend of two green sensitized (with a mixture of GSD-1 and GSD-2) silver iodobromide tabular emulsions: (i) 0.8×0.11 m, 4.5% iodide at 0.330, and (ii) 0.47×0.12 μm, 4.5% iodide at 0.198. Magenta dye-forming coupler MC-1 at 0.404, masking coupler MM-1 at 0.096, and gelatin at 1.488.

Layer 10 (Interlayer): DPA-3 at 0.032, OxDS-1 at 0.076 and gelatin at 0.54.

Layer 11 (Fast Cyan layer): a blend of two red-sensitized sensitized silver iodobromide tabular emulsions: (i) 2.3× 0.13 μm, 3.7 mole % iodide, sensitized with a mixture of RSD-1, RSD-2 and RSD-3 at 0.48 and (ii) 3.9×0.13 μm, 3.7 mole % iodide, sensitized with a mixture of RSD-2, RSD-3, RSD-4 at 0.56. Cyan dye-forming coupler CC-1 at 0.256, IR-5 at 0.040, IR-2 at 0.056, masking coupler CM-1 at 0.024, bleach-accelerator releasing coupler B-1 at 0.012 and gelatin at 1.265.

Layer 12 (Mid Cyan Layer): a red-sensitized (with a mixture of RSD-1, RSD-2, and RSD-3) tabular silver iodobromide emulsion, 1.6×0.13 μm, 3.7 mole % iodide, at 0.880. Cyan dye-forming coupler CC-1 at 0.160, yellow dye-forming coupler YC-1 at 0.040, IR-6 at 0.072, masking coupler CM-1 at 0.024, and gelatin at 1.12.

Layer 13 (Slow cyan layer): a blend of two red-sensitized sensitized silver iodobromide tabular emulsions: (i) 0.95× 0.13 μm, 4.5 mole % iodide, sensitized with a mixture of RSD-1, RSD-2 and RSD-3 at 0.26 and (ii) 0.5×0.08 μm, 3.7 mole % iodide, sensitized with a mixture of RSD-1 and RSD-2 at 0.54. Cyan dye-forming coupler CC-1 at 0.355, masking coupler CM-1 at 0.024, IR-6 at 0.056, bleach accelerator releasing coupler B-1 at 0.096 and gelatin at 2.067.

Layer 14 (Antihalation layer): Black Colloidal Silver at 0.150, OxDS-1 at 0.125, ADD-6 at 0.135, DPA-3 at 0.016, ADD-4 at 0.0012, ADD-3 at 0.007, ADD-5 at 0.0006, UV-1 at 0.075, UV-2 at 0.075 and gelatin at 1.61.

Multilayer Sample A-2

As described for multilayer A-1 except the emulsion, E-1, coated in Layer 7, was replaced by E-2.

Multilayer Sample A-3

As described for multilayer A-2 except DPA-3 was added to Layer 7 at 0.022 and DPA-3 was removed from Layer 6.

Multilayer Sample A-4

As described for multilayer A-2 except MC-1 was removed from Layer 7 and MC-6 was added to Layer 7 at 0.08, DPA-3 was added to Layer 7 at 0.022 and DPA-3 was removed from Layer 6.

Samples of each multilayer element were given a stepped exposure for 0.01 seconds to a light source with an effective color temperature of 5500 K and processed in the KODAK FLEXICOLOR (C-41) process as described in British *Journal of Photography Annual*, 1988, pp 196–198. Green speed was measured in relative log units as 100*(1-logH) where H is the exposure in lux-sec necessary to produce a magenta density 0.5 above Dmin. Relative speed was set equal to 0 for multilayer sample A-1.

Midscale densities were read at Step 11 (approximately 0.8 Status M density units above Dmin in multilayer sample A-1). The relative midscale density was set to 0 for multilayer sample A-1. Relative midscale densities less than 0 represent degraded performance.

TABLE 1

| Multi-layer Sample | Comparison or Invention | Layer 7 Emul-sion | Layer 7 Magenta Coupler | Layer 7 DPA-3 | Speed | Delta Mid-scale Density |
|---|---|---|---|---|---|---|
| A-1 | Comparison | E-1 | MC-1 | – | 0 | 0 |
| A-2 | Comparison | E-2 | MC-1 | – | 2 | −0.09 |
| A-3 | Invention | E-2 | MC-1 | + | 9 | +0.03 |
| A-4 | Invention | E-2 | MC-6 | + | 10 | +0.08 |

The examples in Table 1 illustrate how the combination of a dye-layered, green sensitized emulsion, E-2, and the development promoting agent, DPA-3, in the fast magenta layer of a color negative multilayer film gives good photographic speeds (comparable to or greater than the non dye-layered emulsion of larger grain size) and good midscale densities. In the absence of the development promoting agent, good photographic speeds were seen for the dye-layered emulsion, but there was a significant degradation in midscale density formation.

Example 2

The multilayer film structure utilized for this example is the same as that described in Example 1. Layer 7 was the experimental layer varied in multilayer samples B-1 through B-4. The development promoting agent, DPA-3, was removed from Layer 6 in all samples where it was coated in Layer 7.

Multilayer Sample B-1

As described for multilayer A-1

Multilayer Sample B-2

As described for multilayer A-1 except MC-1 was removed from Layer 7 and MC-6 was added to Layer 7 at 0.08.

Multilayer Sample B-3

As described for multilayer A-1 except the emulsion, E-1, coated in Layer 7, was replaced by E-2.

Multilayer Sample B-4

As described for multilayer B-3 except MC-1 was removed from Layer 7 and MC-6 was added to Layer 7 at 0.08.

Multilayer Sample B-5

As described for multilayer B-4 except DPA-3 was removed from Layer 6 and added to Layer 7 at 0.022.

Samples of each multilayer element were given a stepped exposure for 0.01 seconds to a light source with an effective color temperature of 5500 K and processed in the KODAK FLEXICOLOR (C-41) process as described in *British Journal of Photography Annual*, 1988, pp 196–198. Green speed was measured in relative log units as 100*(1-logH) where H is the exposure in lux-sec necessary to produce a magenta density 0.5 above Dmin. Relative speed was set equal to 0 for multilayer sample B-1.

Midscale densities were read at Step 11 (approximately 0.8 Status M density units above Dmin in multilayer sample B-1). The relative midscale density was set to 0 for multilayer sample B-1. Relative midscale densities less than 0 represent degraded performance.

TABLE 2

| Multi-layer Sample | Comparison or Invention | Layer 7 Emul-sion | Layer 7 Magenta Coupler | Layer 7 DPA-3 | Speed | Delta Mid-scale Density |
|---|---|---|---|---|---|---|
| B-1 | Comparison | E-1 | MC-1 | – | 0 | 0 |
| B-2 | Comparison | E-1 | MC-6 | – | 3 | +0.02 |
| B-3 | Comparison | E-2 | MC-1 | – | 2 | −0.09 |
| B-4 | Invention | E-2 | MC-6 | – | 8 | −0.02 |
| B-5 | Invention | E-2 | MC-6 | + | 10 | +0.08 |

The examples in Table 2 illustrate how the combination of a dye-layered, green sensitized emulsion, E-2, and the magenta dye-forming coupler MC-6 in the fast magenta layer of a color negative film gave improved photographic speeds and a surprisingly large improvement in midscale density formation compared to the sample where the dye-layered emulsion, E-2, was combined with the magenta dye forming coupler MC-1. Note that the increase in midscale density for coatings that used MC-6 compared to MC-1 was larger for samples with the dye-layered emulsion, E-2, than it was for samples with the non dye-layered emulsion, E-1. The largest improvements in midscale density were observed for the even more preferred combination of the dye-layered emulsion, MC-6, and the development promoting agent, DPA-3.

Example 3

The multilayer film structure utilized for this example is the same as that described in Example 1. Layer 7 was the experimental layer varied in multilayer samples C-1 through C-4.

Multilayer Sample C-1

As described for multilayer A-1.

Multilayer Sample C-2

As described for multilayer C-1 except the emulsion, E-1, coated in Layer 7, was replaced by E-2.

Multilayer Sample C-3

As described for multilayer sample C-1 except MC-1 was removed from Layer 7 and MC-12 was added to Layer 7 at 0.19.

Multilayer Sample C-4

As described for multilayer sample C-3 except the emulsion, E-1, coated in Layer 7, was replaced by E-2.

Samples of each multilayer element were given a stepped exposure for 0.01 seconds to a light source with an effective color temperature of 5500 K and processed in the KODAK FLEXICOLOR (C-41) process as described in *British Journal of Photography Annual*, 1988, pp 196–198. Green speed was measured in relative log units as 100*(1-logH) where H is the exposure in lux-sec necessary to produce a magenta density 0.5 above Dmin. Relative speed was set equal to 0 for multilayer sample C-1.

Midscale densities were read at Step 11 (approximately 0.8 Status M density units above Dmin in multilayer sample C-1). The relative midscale densities were set to 0 for the reference multilayer samples (C-1 and C-3) that used the non dye-layered emulsion, E-1. Delta relative midscale densities were determined for each of the coatings that used the dye-layered emulsion, E-2, by comparing them to the non dye-layered coating of the same magenta coupler.

TABLE 3

| Multi-layer Sample | Comparison or Invention | Layer 7 Emul-sion | Layer 7 Magenta Coupler | Layer 7 DPA-3 | Speed | Delta Relative Mid-scale Density |
|---|---|---|---|---|---|---|
| C-1 | Comparison | E-1 | MC-1 | – | 0 | 0 |
| C-2 | Comparison | E-2 | MC-1 | – | 2 | −0.09 |
| C-3 | Comparison | E-1 | MC-12 | – | 0 | 0 |
| C-4 | Invention | E-2 | MC-12 | – | 1 | +0.02 |

The examples in Table 3 illustrate how the combination of a dye-layered, green sensitized emulsion, E-2, and the magenta dye-forming coupler, MC-12, in the fast magenta layer of a color negative multilayer film gives good photographic speeds (comparable to the non dye-layered emulsion of larger grain size) and while preserving good midscale densities. In coatings where MC-1 replaced MC-12 in the fast magenta layer, good photographic speeds were seen for the dye-layered emulsion but there was a significant degradation in midscale density formation.

Example 4

Emulsion E-3 (Invention)

The dye-layered emulsion, E-3, used in the multilayer examples was a sulfur-and-gold sensitized 1.90 μm×0.124 μm silver bromide tabular emulsion containing 4.5 mole % iodide added at 74% of the total silver and containing sodium selenocyanate (1.39 μmole/Ag mole) and potassium hexacyanoruthenate (25 μmole/Ag mole) added at 67% of the total silver. The emulsion was heated to 43° C., after which sodium thiocyanate (100 mg/Ag mole) was added. After a 5' hold, 3-(2-methylsulfamoylethyl)-benzothiazolium tetrafluoroborate (35 mg/Ag mole) was added followed by a 2' hold. Then the first sensitizing dye GSD-1 (574 mg/Ag mole) was added. After a 20' hold, the second sensitizing dye GSD-2 (106 mg/Ag mole) was added with a subsequent 20' hold. This was followed by the addition of sodium aurous dithiosulfate dihydrate (2.1 mg/Ag mole). After a 2' hold, sodium thiosulfate pentahydrate (1.0 mg/Ag mole) was added, followed by a 2' hold. The emulsion was held for 13' at 61° C. After cooling to 43° C., 1-(3-acetamidophenyl)-5-mercaptotetrazole (20 mg/Ag mole) was added with a subsequent 2' hold. Then the GSD-3 layering dye (1.2 mmole/Ag mole) was added followed by a 30' hold. Next, benzenesulfonic acid, 2,5-dihydroxy-4-(1-methylheptadecyl-,monosodium salt) (250 mg/Ag mole) was added followed by a 2' hold. Then, butanedioic acid, sulfo-1,4-bis(2-ethylhexyl) ester, sodium salt (1500 mg/Ag mole) was added with a subsequent 5' hold. Following the hold, 4-hydroxy-6-methyl-1,3,3a,7-tetraazaindene, sodium salt, monohydrate, (0.5 g/Ag mole) was added and then held for 5'. The melt was subsequently chilled at 35° C. and chill set.

Emulsion E-4 (Invention)

The dye-layered emulsion, E-4, used in the multilayer examples was a sulfur-and-gold sensitized 2.37 μm×0.127 μm silver bromide tabular emulsion containing 2.0% iodide in the bromide salt solution, 4.0 mole % iodide added at 74% of the total silver; and containing sodium selenocyanate (1.39 μmole/Ag mole) and potassium hexacyanoruthenate (25 μmole/Ag mole) added at 67% of the total silver. The emulsion was heated to 43° C., after which sodium thiocyanate (100 mg/Ag mole) was added. After a 5' hold, 3-(2-methylsulfamoylethyl)-benzothiazolium tetrafluoroborate (35 mg/Ag mole) was added followed by a 2' hold. Then the first sensitizing dye GSD-1 (529 mg/Ag mole) was added. After a 10' hold, the second sensitizing dye GSD-2 (116 mg/Ag mole) was added with a subsequent 20' hold. This was followed by the addition of sodium aurous dithiosulfate dehydrate (2.0 mg/Ag mole). After a 2' hold, sodium thiosulfate pentahydrate (0.96 mg/Ag mole) was added, followed by a 2' hold. The emulsion was held for 15' at 60° C. After cooling to 43° C., 1-3-acetamidophenyl)-5-mercaptotetrazole (20 mg/Ag mole) was added with a subsequent 2' hold. Then the GSD-3 layering dye (1.2 mmole/Ag mole) was added followed by a 30' hold. Next, benzenesulfonic acid, 2,5-dihydroxy-4-(1-methylheptadecyl-,monosodium salt) (250 mg/Ag mole) was added followed by a 2' hold. Then, butanedioic acid, sulfo-1,4-bis(2-ethylhexyl) ester, sodium salt (1500 mg/Ag mole) was added with a subsequent 5' hold. Following the hold, 4-hydroxy-6-methyl-1,3,3a,7-tetraazaindene, sodium salt, monohydrate, (0.5 g/Ag mole) was added and then held for 5'. The melt was subsequently chilled at 35° C. and chill set.

Multilayer Sample D-1 (Comparison)

The multilayer film structure utilized for this example is detailed below, with structures of components provided at the end of the example section. The coating support was annealed polyethylene naphthalate. Component laydowns are in grams per meter squared and emulsion sizes are reported in diameter×thickness in micrometers. 1,1'-(methylene bis(sulfonyl))bis-ethene hardener was used at 1.6% of total gelatin weight. Antifoggants (including 4-hydroxy-6-methyl-1,3,3a,7-tetraazaindene), surfactants, coating aids, coupler solvents, emulsion addenda, sequesterants, lubricants, matte and tinting dyes were added to the appropriate layers as is common in the art. Layers are numbered beginning with the layer furthest from the support. Layer 7 was the experimental layer varied in multilayer sample D-2.

Layer 1 (Protective Overcoat Layer): gelatin at 0.87.

Layer 2 (UV Filter Layer): silver bromide Lippmann emulsion at 0.215, UV-1 at 0.107, UV-2 at 0.107, ADD-01 at 0.0014, and gelatin at 0.86.

Layer 3 (Fast Yellow Layer): a blend of a blue sensitized (with a mixture of BSD-1 and BSD-2) tabular silver iodobromide emulsion, 2.7×0.13 μm, 4.1 mole % iodide at 0.16, and a blue sensitized (BSD-2) three dimensional silver iodobromide emulsion, 1.2 μm, 9.7 mole % iodide at 0.84. Yellow dye-forming coupler YC-1 at 0.072, YC-3 at 0.072, IR-1 at 0.056, bleach accelerator releasing coupler B-1 at 0.0104 and gelatin at 0.861.

Layer 4 (Mid Yellow Layer): a blend of two blue sensitized (both with a mixture of BSD-1 and BSD-2) tabular silver iodobromide emulsions: (i) 2.4×0.14 μm, 2.0 mole % iodide at 0.192 and (ii) 0.97×0.14 μm, 2.0 mole % iodide at 0.233. Yellow dye-forming couplers YC-1 at 1.000, IR-1 at 0.08, DPA-3 at 0.048 and gelatin at 1.700.

Layer 5 (Slow Yellow Layer): a blend of three blue sensitized (each with a mixture of BSD-1 and BSD-2) tabular silver iodobromide emulsions: (i) 0.99×0.14 μm, 1.4 mole % iodide at 0.080; (ii) 0.5×0.08 μm, 1.3 mole % iodide at 0.160 and (iii) 0.62×0.11 μm, 2.6 mole % iodide at 0.200. Yellow dye-forming couplers YC-1 at 0.216 and YC-2 at 0.144, IR-2 at 0.048, bleach accelerator releasing coupler B-1 at 0.0064, and gelatin at 1.076.

Layer 6 (Interlayer): OxDS-1 at 0.080, ADD-02 at 0.0027, and gelatin at 0.8.

Layer 7 (Fast Magenta Layer): a blend of green sensitized iodobromide tabular emulsions: (i) E-1, at 0.72, and (ii) 1.75×0.13 μm, 4.5 mole % iodide at 0.360 as well as magenta dye-forming coupler MC-6 at 0.080, DPA-3 at 0.024, masking coupler MM-1 at 0.056, IR-3 at 0.016, IR-7 at 0.0024, IR-4 at 0.016 and gelatin at 1.380.

Layer 8 (Mid Magenta Layer): a blend of two green sensitized (with a mixture of GSD-1 and GSD-2) silver iodobromide tabular emulsions: (i) 1.75×0.13 μm, 4.5 mole % iodide at 0.280 and (ii) 1.3×0.13 μm, 4.5 mole % iodide at 0.560. Magenta dye-forming coupler MC-1 at 0.200, masking coupler MM-1 at 0.104, IR-3 at 0.016, IR-7 at 0.0024, IR-4 at 0.008, and gelatin at 1.378.

Layer 9 (Slow magenta layer): a blend of two green sensitized (with a mixture of GSD-1 and GSD-2) silver iodobromide tabular emulsions: (i) 0.8×0.11 μm, 4.5% iodide at 0.360, and (ii) 0.47×0.12 μm, 4.5% iodide at 0.200. Magenta dye-forming coupler MC-1 at 0.440, masking coupler MM-1 at 0.096, IR-3 at 0.008, IR-7 at 0.0024, IR-4 at 0.008, OxODS-1 @ 0.012 and gelatine at 1.507.

Layer 10 (Interlayer): OxDS-1 at 0.076 and gelatin at 0.54.

Layer 11 (Fast Cyan layer): a blend of two red-sensitized sensitized silver iodobromide tabular emulsions: (i) 2.3×0.13 μm, 3.7 mole % iodide sensitized with a mixture of RSD-1, RSD-2 and RSD-3 at 0.560 and (ii) 3.9×0.1 3 μm, 3.7 mole % iodide, sensitized with a mixture of RSD-1, RSD-2 and RSD-3 at 0.480. Cyan dye-forming coupler CC-1 at 0.200, IR-5 at 0.056, IR-6 at 0.048, masking coupler CM-1 at 0.032, bleach accelerator releasing coupler B-1 at 0.0.016, DPA-12 at 0.072 and gelatin at 1.448.

Layer 12 (Mid Cyan Layer): a red-sensitized (with a mixture of RSD-1, RSD-2, and RSD-3) tabular silver iodobromide emulsion, 1.6×0.13 μm, 3.7 mole % iodide, at 0.840. Cyan dye-forming coupler CC-1 at 0.248, yellow dye-forming coupler YC-1 at 0.040, IR-2 at 0.048, masking coupler CM-1 at 0.008, bleach accelerator releasing coupler B-1 at 0.0048, DPA-12 at 0.072 and gelatin at 1.214.

Layer 13 (Slow cyan layer): a blend of three red-sensitized sensitized silver iodobromide tabular emulsions(all sensitized with a mixture of RSD-1, RSD-2 and RSD-3): (i) 0.95×0.13 μm, 4.5 mole % iodide at 0.216, (ii) 0.69×0.11 μm, 4.5 mole % iodide at 0.048, and (iii) 0.44×0.11, 0.5 mole % iodide at 0.616. Cyan dye-forming coupler CC-1 at 0.400, masking coupler CM-1 at 0.016, IR-6 at 0.048, bleach accelerator releasing coupler B-1 at 0.104 and gelatin at 2.067.

Layer 14 (Antihalation layer): Black Colloidal Silver at 0.150, OxDS-1 at 0.125, DPA-3 at 0.024, ADD-3 at 0.007, and gelatin at 1.615.

Multilayer Sample D-2 (Invention)

As described for D-1 except the emulsions coated in Layer 7, were replaced by inventive, dye-layered analogs E-3 and E-4. The actual laydowns used were E3 at 0.480 and E4 at 0.240. In addition the levels of coupler MC-6 was adjusted to 0.076 and the level of MM-1 was also adjusted to 0.044 in layer 7 to provide matched contrast/density with D-1.

Samples of each multilayer element were given a stepped exposure for 0.01 seconds to a light source with an effective color temperature of 5500 K and processed in the KODAK FLEXICOLOR (C-41) process as described in *British Journal of Photography Annual*, 1988, pp 196–198 to establish their respective initial performance. Following development, the optical image dye density was measured for each step of the stepwise exposure and the characteristic profile curve was generated for each multilayer sample. Green speed was measured in relative log units as 100*(1-logH) where H is the exposure in lux-sec necessary to produce a magenta density 0.15 above Dmin. The photographic sensitivity of multilayer sample D-1 (comparative) was set equal to zero when compared to the other samples. A difference of +30 units in relative green speed represents +0.30 log E or one stop improvement of photographic sensitivity (a doubling of speed).

Granularity of the above stepwise exposure on the multilayer samples was determined by the RMS method (see The Theory of the Photographic Process, $4^{th}$ edition, T. H. James editor, Macmillan Publishing Co., New York, 1977) using a 48 μm aperature. RMS granularity is the root-mean-squared standard deviation or local density variability in an area of overall uniform density. A 5% reduction in relative RMS granularity offers a noticeable improvement in graininess and was defined as 1 GU (Grain Unit) by D. Zwick and D. Brothers (*J. Soc. Mot. Pict. Telev. Eng.*, vol. 86, pp. 427–430, 1977). The RMS granularity from stepwise exposure of each multilayer sample was measured at 0.2 log E increments. The RMS values were squared, summed, and averaged for each multilayer sample. The square root of the average RMS granularity of multilayer sample D-1 was set equal to zero and compared to the other multilayer samples. Relative Green Grain (granularity) for multilayer sample D-2 relative to multilayer sample D-1 are given in Table 4. A difference of −1 in Relative Green Grain represents a 1 GU improvement in granularity.

TABLE 4

| | | Relative Green Record Performance (0 mR) | | Relative Green Grain (0 mR) |
|---|---|---|---|---|
| Sample | Feature | D-min | 0.15 Speed | D-min |
| D-1 | comparison | 0.000 | 0.000 | 0 |
| D-2 | invention | 0.010 | 2.2 | −1.5 |

The data clearly show that the inventive combination expressed in D-2 shows higher speed and lower granularity in the Dmin position prior to exposure to simulated background radiative processes.

In order to assess the susceptibility of emulsions to high energy background radiation exposure, the multilayer elements, both comparative (D-1) and inventive (D-2) were uniformly exposed to an Iridium 192 radiation source, for set lengths of time in order to provide desired net exposure increments measured in milliRoentgen (mR). Each sample was then optically exposed and processed as described above. Internal comparison of the initial performance with the performance obtained after exposure to the radiation source for 35 and 70 mR is summarized in Table 5.

TABLE 5

| | | delta Green D-min | | delta Green 0.15 speed | | delta Green Grain @ Dmin | |
|---|---|---|---|---|---|---|---|
| Example | Feature | 35 mR | 70 mR | 35 mR | 70 mR | 35 mR | 70 mR |
| D-1 | comparison | 0.034 | 0.062 | −3.2 | −5.5 | 13 | 17 |
| D-2 | invention | 0.021 | 0.04 | −2.2 | −3.9 | 9 | 14 |

As can be seen from the data, the Invention (D-2) displays LESS Dmin growth, GREATER speed preservation AND less noise or granularity gain in the D-min region.

Example 5

Emulsion E-5 (Invention)

The dye-layered emulsion, E-5, used in the multilayer examples was a sulfur-and-gold sensitized 2.12 μm×0.127 μm silver bromide tabular emulsion containing 2.0% iodide in the bromide salt solution, 4.5 mole % iodide added at 74% of the total silver; and containing sodium selenocyanate (1.39 μmole/Ag mole) and potassium hexacyanoruthenate (25 μmole/Ag mole) added at 67% of the total silver. The emulsion was heated to 43° C., after which sodium thiocyanate (100 mg/Ag mole) was added. After a 5' hold, 3-(2-methylsulfamoylethyl)-benzothiazolium tetrafluoroborate (35 mg/Ag mole) was added followed by a 2' hold. Then the first sensitizing dye GSD-1 (519 mg/Ag mole) was added. After a 10' hold, the second sensitizing dye GSD-2 (114 mg/Ag mole) was added with a subsequent 20' hold. This was followed by the addition of sodium aurous dithiosulfate dihydrate (2.18 mg/Ag mole). After a 2' hold, sodium thiosulfate pentahydrate (1.03 mg/Ag mole) was added, followed by a 2' hold. The emulsion was held for 15' at 60° C. After cooling to 43° C., 1-(3-acetamidophenyl)-5-mercaptotetrazole (20 mg/Ag mole) was added with a subsequent 2' hold. Then the GSD-3 layering dye (1.2 mmole/Ag mole) was added followed by a 30' hold. Next, benzenesulfonic acid, 2,5-dihydroxy-4-(1-methylheptadecyl-,monosodium salt) (250 mg/Ag mole) was added followed by a 2' hold. Then, butanedioic acid, sulfo-1,4-bis(2-ethylhexyl) ester, sodium salt (1500 mg/Ag mole) was added with a subsequent 5' hold. Following the hold, 4-hydroxy-6-methyl-1,3,3a,7-tetraazaindene, sodium salt, monohydrate, (0.5 g/Ag mole) was added and then held for 5'. The melt was subsequently chilled at 35° C. and finally allowed to chill set.

Multilayer Sample F-1 (Comparative)

As described for multilayer sample D-1 with the following exceptions:

Layer 9 (Slow magenta layer): a blend of two green sensitized (with a mixture of GSD-1 and GSD-2) silver iodobromide tabular emulsions: (i) 0.8×0.11 μm, 4.5% iodide at 0.320, and (ii) 0.47×0.12 μm, 4.5% iodide at 0.160. Magenta dye-forming coupler MC-1 at 0.440, masking coupler MM-1 at 0.096, IR-3 at 0.008, IR-7 at 0.0024, IR-4 at 0.008, OxODS-1 @ 0.012 and gelatine at 1.507.

Layer 11 (Fast Cyan layer): a blend of red-sensitized (each sensitized with a mixture of RSD-1, RSD-2 and RSD-3) silver iodobromide tabular emulsion: (i) 2.7×0.13 μm, 3.7 mole % iodide 0.720. and (ii) a 2.3×0.13 μm, 3.7 mole % iodide at 0.240. Cyan dye-forming coupler CC-1 at 0.176, IR-5 at 0.064, IR-6 at 0.048, masking coupler CM-1 at 0.032, bleach accelerator releasing coupler B-1 at 0.0112, DPA-12 at 0.072 and gelatin at 1.448.

Layer 12 (Mid Cyan Layer): a red-sensitized (with a mixture of RSD-1, RSD-2, and RSD-3) tabular silver iodobromide emulsion, 1.6×0.13 μm, 3.7 mole % iodide, at 0.840. Cyan dye-forming coupler CC-1 at 0.256, yellow dye-forming coupler YC-1 at 0.040, IR-6 at 0.064, masking coupler CM-1 at 0.008, bleach accelerator releasing coupler B-1 at 0.0064, DPA-2 at 0.072 and gelatin at 1.214.

Multilayer Sample F-2 (Invention)

As described for multilayer sample F-1 with the following exceptions: The emulsions in Layer 7 were replaced with the dye-layered inventive emulsion E5 at 0.720. The levels of MC-6 and MM-1 were the same as in multilayer sample D-2.

Samples of each multilayer element were given a stepped exposure for 0.01 seconds to a light source with an effective color temperature of 5500 K and processed in the KODAK FLEXICOLOR (C-41) process as described in *British Journal of Photography Annual*, 1988, pp 196–198 to establish their respective initial performance. Green speed was measured in relative log units as 100*(1-logH) where H is the exposure in lux-sec necessary to produce a magenta density 0.15 above Dmin. The eighth step (Step 8) of the exposed multilayer samples represents a region of the characteristic curve where the density (Status M) is approximately 0.25 to 0.30 above Dmin. Relative speed was set equal to 0.00 for multilayer sample F-1. The comparison of initial performance is summarized in Table 6.

TABLE 6

| | | Relative Green Record Performance (0 mR) | | Green Grain (0 mR) at | |
|---|---|---|---|---|---|
| Sample | Feature | D-min | 0.15 Speed | D-min | Step 8 |
| F-1 | comparison | 0.000 | 0.000 | 0.0 | 0.0 |
| F-2 | invention | −0.004 | 2.2 | −5.0 | −3.0 |

As can be seen from the data in Table 6, the Inventive multilayer sample (F-2) displays improved noise or granularity both in the Dmin as well as at Step 8 of the exposed and processed multilayer samples, while at the same time having near equal Dmin and superior measured sensitivity or speed.

In order to assess the susceptibility of emulsions to high energy background radiation exposure, the multilayer elements, both comparative (F-1) and inventive (F-2) were uniformly exposed to an Iridium isotope radiation source, for set lengths of time in order to provide desired net exposure increments measured in milliRoentgen (mR). Each sample was then optically exposed and processed as described above. Internal comparison of the initial performance with the performance obtained after exposure to the radiation source for 35, 70 and 105 mR is summarized in Table 7.

TABLE 7

| | | delta Green D-min | | | delta Green 0.15 speed | | | Delta Green Grain at Dmin | | |
|---|---|---|---|---|---|---|---|---|---|---|
| Example | Feature | 35 mR | 70 mR | 105 mR | 35 mR | 70 mR | 105 mR | 35 mR | 70 mR | 105mR |
| F-1 | comparison | 0.033 | 0.061 | 0.088 | −3.8 | −6.4 | −9.2 | 10.0 | 15.5 | 17.0 |
| F-2 | invention | 0.018 | 0.040 | 0.058 | −2.8 | −4.7 | −7.0 | 9.0 | 14.0 | 16.0 |

As can be seen from the data, the Invention (F-2) displays LESS Dmin growth, GREATER speed preservation AND less noise or granularity gain.

Example 6

Multilayer Sample G-1 (Comparative)

As described for multilayer sample F-1 with the following exceptions:

Layer 3 (Fast Yellow Layer): a blend of a blue sensitized (with a mixture of BSD-1 and BSD-2) tabular silver iodobromide emulsion, 2.7×0.13 μm, 4.1 mole % iodide at 0.16, and a blue sensitized (BSD-2) three dimensional silver iodobromide emulsion, 1.2 μm, 9.7 mole % iodide at 0.840. Yellow dye-forming coupler YC-1 at 0.256, IR-1 at 0.064, bleach accelerator releasing coupler B-1 at 0.0104 and gelatin at 0.861.

Layer 4 (Mid Yellow Layer): a blend of two blue sensitized (both with a mixture of BSD-1 and BSD-2) tabular silver iodobromide emulsions: (i) 1.3×0.14 μm, 4.1 mole % iodide at 0.280 and (ii) 0.99×0.14 μm, 1.4 mole % iodide at 0.240. Yellow dye-forming couplers YC-1 at 1.000, IR-1 at 0.056 and gelatin at 1.700.

Layer 5 (Slow Yellow Layer): a blend of two blue sensitized (each with a mixture of BSD-1 and BSD-2) tabular silver iodobromide emulsions: (i) 0.99×0.14 μm, 1.4 mole % iodide at 0.136 and (ii) 0.5×0.08 μm, 1.3 mole % iodide at 0.264. Yellow dye-forming couplers YC-1 at 0.216 and YC-2 at 0.144, IR-2 at 0.032, bleach accelerator releasing coupler B-1 at 0.0064, and gelatin at 1.076.

Layer 10 (Interlayer): OxDS-1 at 0.076, YFD-1 at 0.104 and gelatin at 0.54.

Layer 11 (Fast Cyan layer): a red-sensitized (sensitized with a mixture of RSD-1, RSD-2 and RSD-3) silver iodobromide tabular emulsion: (i) 2.7×0.13 μm, 3.7 mole % iodide 0.960. Cyan dye-forming coupler CC-1 at 0.176, IR-5 at 0.064, IR-6 at 0.048, masking coupler CM-1 at 0.032, bleach accelerator releasing coupler B-1 at 0.0112, DPA-12 at 0.072 and gelatin at 1.448.

Layer 12 (Mid Cyan Layer): a blend of red-sensitized (each with a mixture of RSD-1, RSD-2, and RSD-3) tabular silver iodobromide emulsion: (i) 1.6×0.13 μm, 3.7 mole % iodide, at 0.560 and (ii) a 2.3×0.13 μm, 3.7 mole % iodide at 0.320. Cyan dye-forming coupler CC-1 at 0.256, yellow dye-forming coupler YC-1 at 0.040, IR-6 at 0.064, IR-5 at 0.024, masking coupler CM-1 at 0.008, bleach accelerator releasing coupler B-1 at 0.0064, DPA-12 at 0.072 and gelatin at 1.214.

Multilayer Sample G-2 (Invention)

As described for multilayer sample G-1 with the following exceptions: The emulsions in Layer 7 were replaced with the dye-layered inventive emulsion E5 at 0.720. The level of MM-1 was the same as in multilayer sample D-2. In addition the level of MC-1 in layer 8 was changed to 0.232.

Samples of each multilayer element were given a stepped exposure for 0.01 seconds to a light source with an effective color temperature of 5500 K and processed in the KODAK FLEXICOLOR (CA-41) process as described in *British Journal of Photography Annual*, 1988, pp 196–198 to establish their respective initial performance. Green speed was measured in relative log units as (1-logH) where H is the exposure in lux-sec necessary to produce a magenta density 0.15 above Dmin. The eighth step (Step 8) of the exposed multilayer samples represents a region of the characteristic curve where the density (Status M) is approximately 0.25 to 0.30 above Dmin. Relative speed was set equal to 0.00 for multilayer sample G-1. The comparison of initial performance is summarized in Table 8.

TABLE 8

| | | Relative Green Record Performance (0 mR) | | Green Grain (0 mR) at | |
|---|---|---|---|---|---|
| Sample | Feature | D-min | 0.15 Speed | D-min | Step 8 |
| G-1 | comparison | 0.000 | 0.00 | 0.0 | 0.0 |
| G-2 | invention | 0.007 | 1.1 | −1.0 | −2.0 |

As can be seen from the data in Table 8, the Inventive multilayer sample (G-2), displays improved noise or granularity both in the Dmin as well as at Step 8 of the exposed and processed multilayer samples. This advantage in noise is enjoyed while at the same time having near equal Dmin and superior measured sensitivity or speed.

In order to assess the susceptibility of emulsions to high energy background radiation exposure, the multilayer elements, both comparative (G-1) and inventive (G-2) were uniformly exposed to an Iridium isotope radiation source, for set lengths of time in order to provide desired net exposure increments measured in milliRoentgen (mR). Each sample was then optically exposed and processed as described above. Internal comparison of the initial performance with the performance obtained after exposure to the radiation source for 35, 70 and 105 mR is summarized in Table 9.

-continued

CC-1

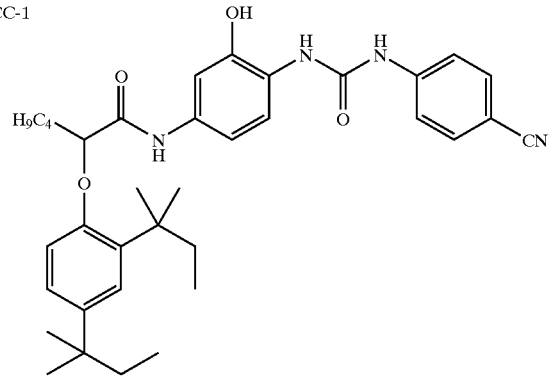

TABLE 9

| | | delta Green D-min | | | delta Green 0.15 speed | | | delta Green Grain at Dmin | | |
|---|---|---|---|---|---|---|---|---|---|---|
| Example | Feature | 35 mR | 70 mR | 105 mR | 35 mR | 70 mR | 105 mR | 35 mR | 70 mR | 105mR |
| G-1 | comparison | 0.022 | 0.055 | 0.074 | −2.3 | −5.7 | −7.6 | 11.0 | 16.5 | 20.0 |
| G-2 | invention | 0.021 | 0.047 | 0.061 | −1.6 | −4.7 | −5.3 | 7.5 | 13.0 | 15.0 |

As can be seen from the data, the Invention (G-2) displays LESS Dmin growth, GREATER speed preservation AND less noise or granularity gain.

UV-1

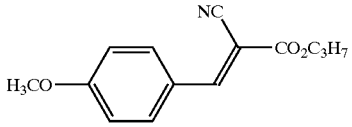

UV-2

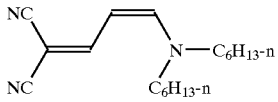

YC-1

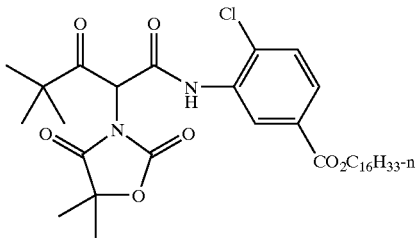

YC-2

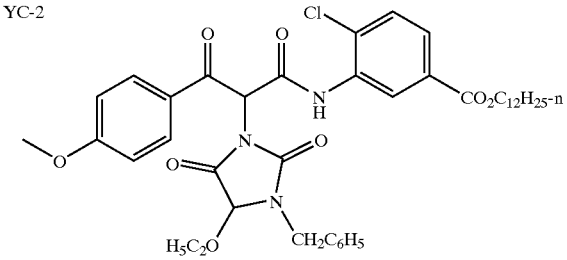

-continued

MM-1

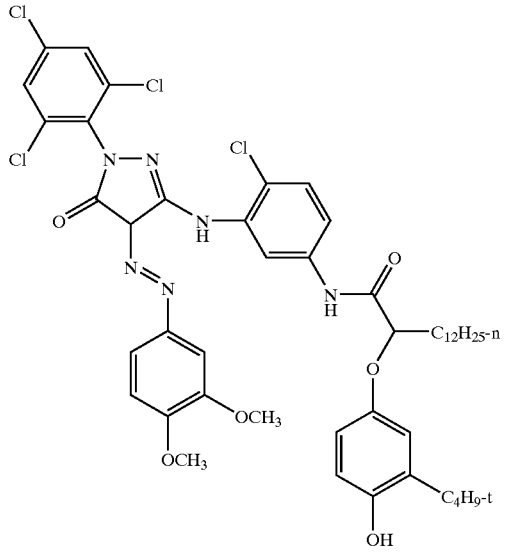

CM-1

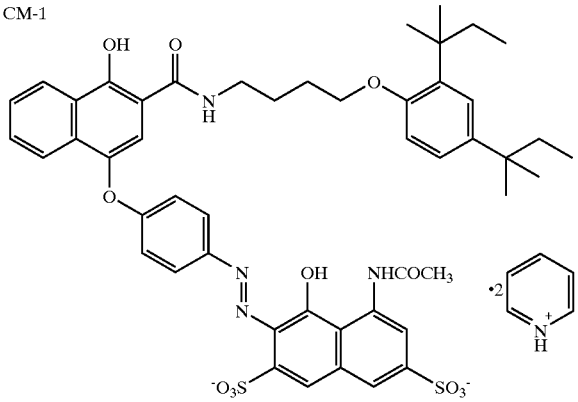

-continued
IR-1
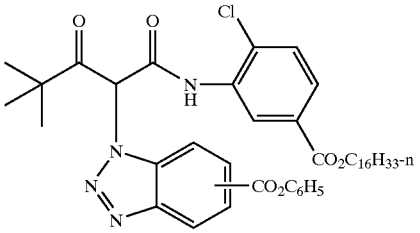
YC-3
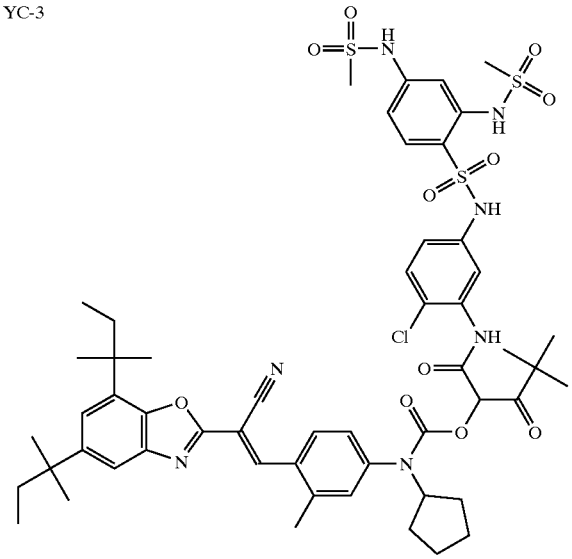
IR-3
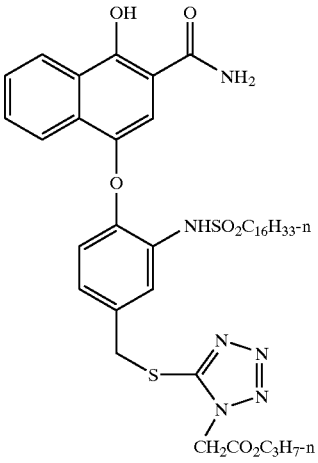
IR-4
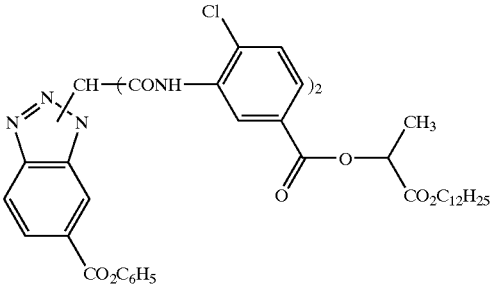
-continued
IR-5
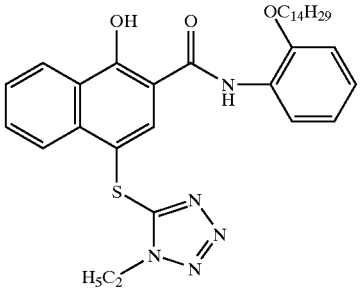
IR-2
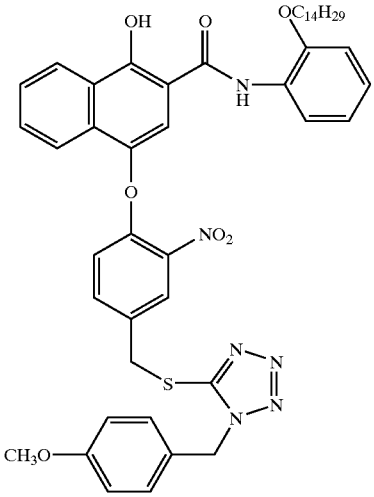
IR-6
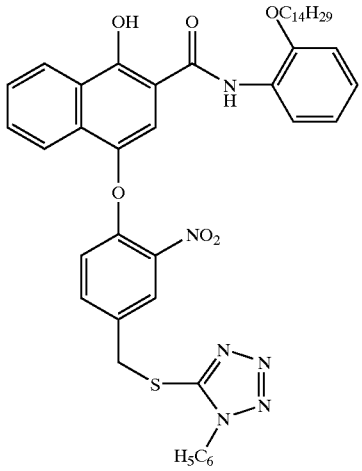
B-1
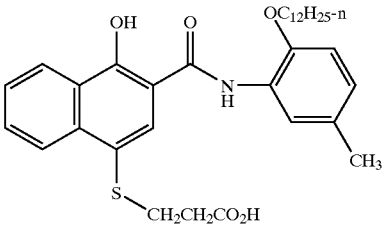

-continued
IR-7
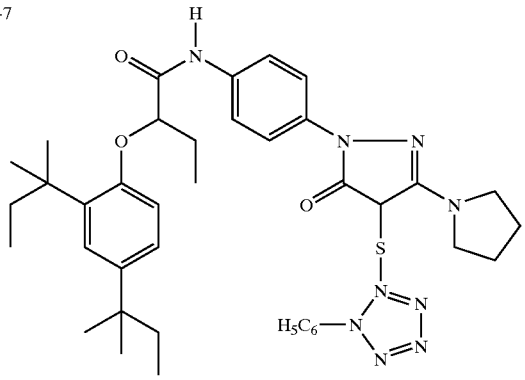
BSD-1
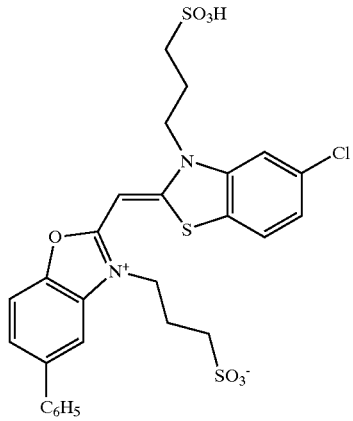
BSD-2
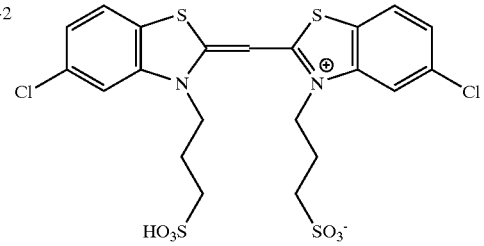
GSD-1
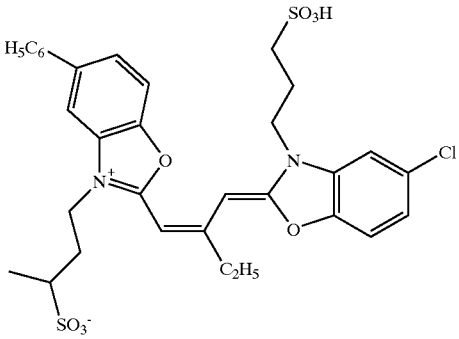
GSD-2
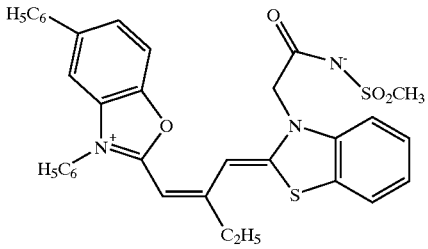
-continued
GSD-3
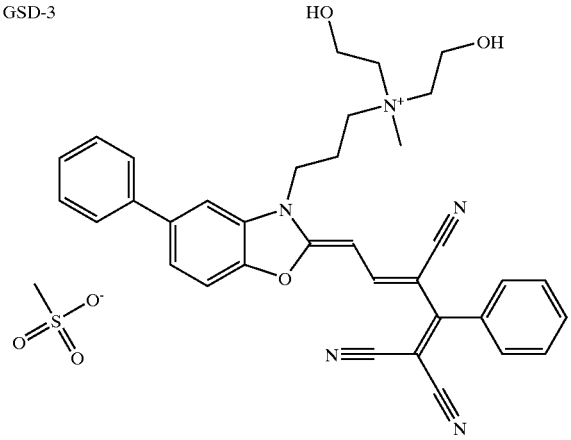
RSD-1
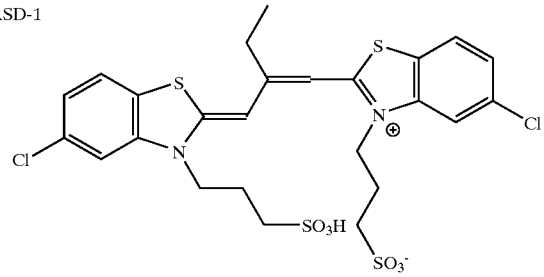
RSD-2
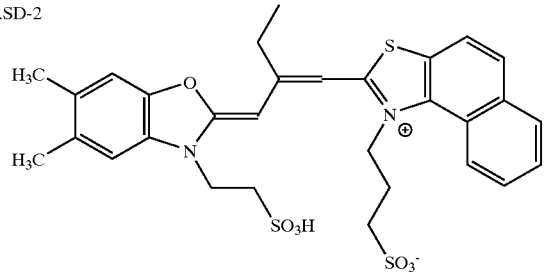
RSD-3
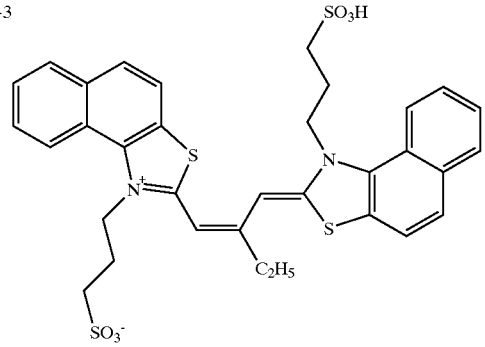

-continued

RSD-4

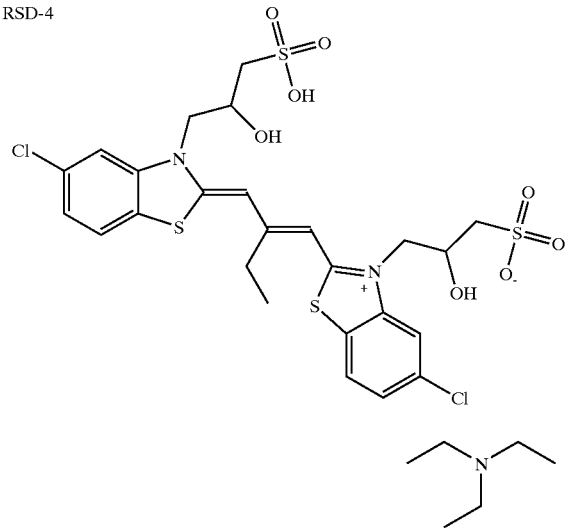

OxDS-1

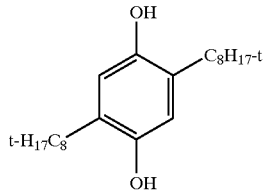

ADD-6

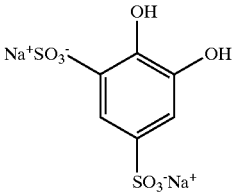

YFD-1

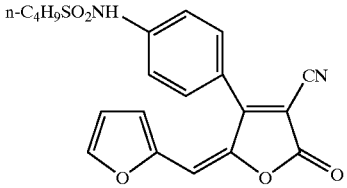

ADD-2

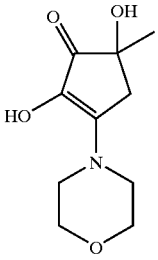

ADD-5

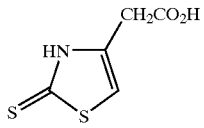

ADD-4

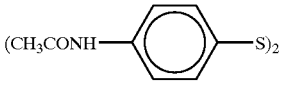

ADD-3 Sodium Hexametaphosphate

ADD-1 $MnSO_4$

The invention has been described in detail with particular reference to certain preferred embodiments thereof, but it will be understood that variations and modifications can be effected within the spirit and scope of the invention.

What is claimed is:

1. A silver halide photographic element comprising a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler, wherein at least one of the dye image forming units contains layers of differing sensitivities, and the layer of highest sensitivity contains a development promoting agent and a silver halide emulsion comprising tabular silver halide grains having associated therewith at least two dye layers comprising (a) an inner dye layer adjacent to the silver halide grain and comprising at least one dye, Dye 1, that is capable of spectrally sensitizing silver halide and (b) an outer dye layer adjacent to the inner dye layer and comprising at least one dye, Dye 2, wherein the dye layers are held together by more than one non-covalent force; the outer dye layer absorbs light at equal or higher energy than the inner dye layer; and the energy emission wavelength of the outer dye layer overlaps with the energy absorption wavelength of the inner dye layer.

2. The silver halide photographic element of claim 1 wherein Dye 1 comprises at least one anionic substituent, and Dye 2 comprises at least one cationic substituent.

3. The silver halide photographic element of claim 1 wherein Dye 1 is a cyanine dye and Dye 2 is a dye other than a cyanine dye.

4. The silver halide photographic element of claim 2 wherein Dye 1 is a cyanine dye and Dye 2 is a dye other than a cyanine dye.

5. The silver halide photographic element of claim 1 wherein the dye image forming unit containing the dye layered silver halide emulsion is the magenta dye image forming unit.

6. The silver halide photographic element of claim 1 wherein the development promoting agent is a heterocycle that contains at least three heteroatoms.

7. The silver halide photographic element of claim 6 wherein the heterocycle is a tetrazindene (including purines), triazole, tetrazole, thiadiazole or oxadiazole.

8. The silver halide photographic element of claim 7 wherein the heterocycle is a purine and the development promoting agent has a ClogP of at least 6.2.

9. The silver halide photographic element of claim 7 wherein the heterocycle is a purine and the development promoting agent has a ClogP of at least 7.2.

10. The silver halide photographic element of claim 7 wherein the heterocycle is a triazole and the development promoting agent has a ClogP of at least 8.75.

11. The silver halide photographic element of claim 7 wherein the heterocycle is a triazole and the development promoting agent has a ClogP of at least 9.25.

12. The silver halide photographic element of claim 7 wherein the heterocycle is a benzotriazole and the development promoting agent has a ClogP of at least 7.8.

13. The silver halide photographic element of claim 7 wherein the heterocycle is a benzotriazole and the development promoting agent has a ClogP of at least 9.0.

14. The silver halide photographic element of claim 7 wherein the heterocycle is a tetrazole and the development promoting agent has a ClogP of at least 6.5.

15. The silver halide photographic element of claim 7 wherein the heterocycle is a tetrazole and the development promoting agent has a ClogP of at least 7.5.

16. The silver halide photographic element of claim 7 wherein the heterocycle is a thiadiazole or oxathiazole and the development promoting agent has a ClogP of at least 7.6.

17. The silver halide photographic element of claim 7 wherein the heterocycle is a thiadiazole or oxathiazole and the development promoting agent has a ClogP of at least 8.2.

18. The silver halide photographic element of claim 1 wherein the development promoting agent is present in an amount of at least 0.4 mmol of development promoting agent per mol of silver halide.

19. The silver halide photographic element of claim 1 wherein the development promoting agent is present in an amount of at least 4.0 mmol of development promoting agent per mol of silver halide.

20. The silver halide photographic element of claim 1 wherein the development promoting agent is:

DPA-1: (6.91)

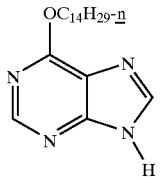

DPA-2: (8.32)

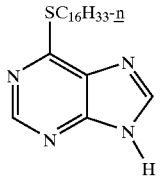

DPA-3: (7.84)

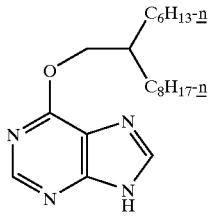

DPA-4: (6.98)

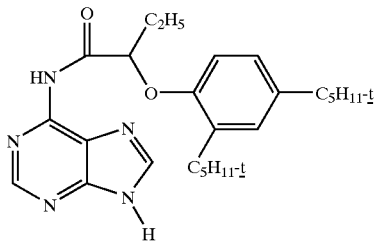

-continued

DPA-5: (7.99)

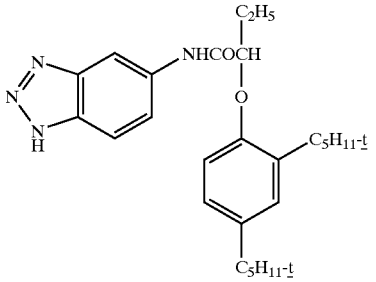

DPA-6: (10.66)

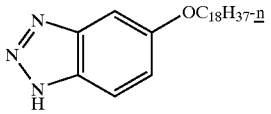

DPA-7: (12.07)

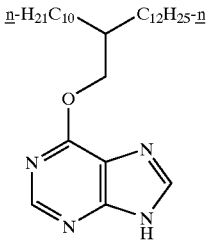

DPA-8: (10.23)

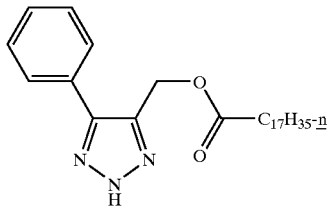

DPA-9: (9.04)

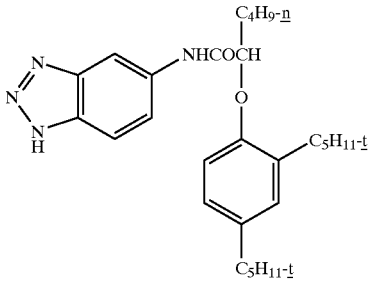

DPA-10: (10.84)

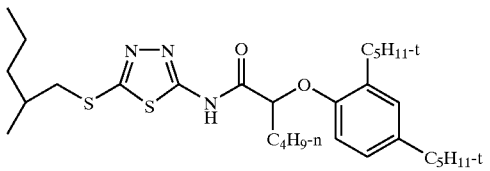

DPA-11: (10.12)

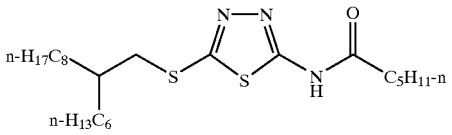

-continued

DPA-12:
(9.91)

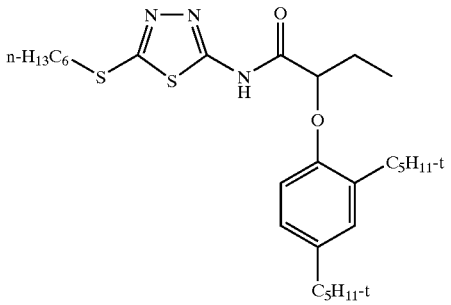

21. The silver halide photographic element of claim 1, wherein the coupler utilized in the layer containing the dye layered silver halide emulsion is a pyrazolotriazole.

22. The silver halide photographic element of claim 21, wherein the coupler is represented by Formula IIIa:

(Formula IIIa)

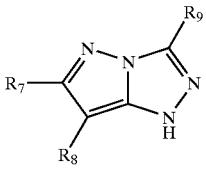

where $R_7$ is an alkyl, aryl, alkyloxy or aryloxy group, $R_8$ is a coupling group, and $R_9$ is an alkyl or aryl group containing at least 8 carbon atoms.

23. The silver halide photographic element of claim 3, wherein the coupler is

MC-6:

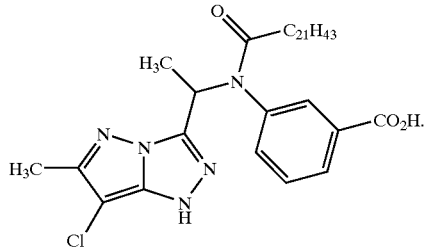

24. The silver halide photographic element of claim 1 wherein the layer comprising the dye layered emulsion further comprises a development inhibitor releasing compound.

25. The silver halide photographic element of claim 1 wherein the silver halide photographic element further comprises a yellow filter dye in a layer between the support and the green sensitized layer closest to the support.

26. The silver halide photographic element of claim 1 wherein the silver halide photographic clement is utilized in a one time use camera.

* * * * *